US009000364B2

(12) United States Patent
Ermakov et al.

(10) Patent No.: US 9,000,364 B2
(45) Date of Patent: Apr. 7, 2015

(54) ELECTROSTATIC ION TRAP

(75) Inventors: Alexei Victorovich Ermakov, Highland Park, NJ (US); Barbara Jane Hinch, Edison, NJ (US)

(73) Assignee: MKS Instruments, Inc., Andover, MA (US)

( * ) Notice: Subject to any disclaimer, the term of this patent is extended or adjusted under 35 U.S.C. 154(b) by 1517 days.

(21) Appl. No.: 12/514,339

(22) PCT Filed: Nov. 13, 2007

(86) PCT No.: PCT/US2007/023834

§ 371 (c)(1), (2), (4) Date: Dec. 2, 2009

(87) PCT Pub. No.: WO2008/063497

PCT Pub. Date: May 29, 2008

(65) Prior Publication Data

US 2010/0084549 A1 Apr. 8, 2010

Related U.S. Application Data

(60) Provisional application No. 60/858,544, filed on Nov. 13, 2006.

(51) Int. Cl.
*H01J 49/28* (2006.01)
*H01J 49/42* (2006.01)

(52) U.S. Cl.
CPC ..... *H01J 49/4245* (2013.01)

(58) Field of Classification Search
None
See application file for complete search history.

(56) References Cited

U.S. PATENT DOCUMENTS

| | | | | | |
|---|---|---|---|---|---|
| 2,570,158 | A | * | 10/1951 | Schissel | 250/282 |
| 3,107,295 | A | * | 10/1963 | Tretner | 250/293 |
| 3,174,034 | A | * | 3/1965 | Behrisch et al. | 250/293 |
| 3,226,543 | A | * | 12/1965 | Melzner | 250/287 |
| 3,258,591 | A | * | 6/1966 | Blauth et al. | 250/286 |
| 3,258,592 | A | * | 6/1966 | Blauth et al. | 250/293 |
| 5,381,006 | A | * | 1/1995 | Wells et al. | 250/282 |
| 6,483,109 | B1 | * | 11/2002 | Reinhold et al. | 250/292 |

(Continued)

FOREIGN PATENT DOCUMENTS

| | | | |
|---|---|---|---|
| CA | 2239399 | A1 * | 12/1999 |
| CA | 2239399 | C * | 4/2004 |

(Continued)

OTHER PUBLICATIONS

Blauch, E.W., "Dynamic Mass Spectrometers," Elsevier Publishing Company (1966), pp. 124-134.

(Continued)

*Primary Examiner* — Andrew Smyth
(74) *Attorney, Agent, or Firm* — Hamilton, Brook, Smith & Reynolds, P.C.

(57) ABSTRACT

An electrostatic ion trap confines ions of different mass to charge ratios and kinetic energies within an anharmonic potential well. The ion trap is also provided with a small amplitude AC drive that excites confined ions. The mass dependent amplitudes of oscillation of the confined ions are increased as their energies increase, due to an autoresonance between the AC drive frequency and the natural oscillation frequencies of the ions, until the oscillation amplitudes of the ions exceed the physical dimensions of the trap, or the ions fragment or undergo any other physical or chemical transformation.

43 Claims, 24 Drawing Sheets

(56) References Cited

U.S. PATENT DOCUMENTS

| | | | | |
|---|---|---|---|---|
| 6,737,641 | B2 * | 5/2004 | Kato | 250/281 |
| 6,828,551 | B2 * | 12/2004 | Kato | 250/281 |
| 6,888,130 | B1 * | 5/2005 | Gonin | 250/287 |
| 6,900,430 | B2 * | 5/2005 | Okumura et al. | 250/281 |
| 6,998,610 | B2 * | 2/2006 | Wang | 250/290 |
| 7,019,289 | B2 * | 3/2006 | Wang | 250/290 |
| 7,026,610 | B2 * | 4/2006 | Kato | 250/285 |
| 7,049,580 | B2 * | 5/2006 | Londry et al. | 250/282 |
| 7,071,464 | B2 * | 7/2006 | Reinhold | 250/282 |
| 7,227,137 | B2 * | 6/2007 | Londry et al. | 250/292 |
| 7,329,866 | B2 * | 2/2008 | Wang | 250/290 |
| 8,586,918 | B2 * | 11/2013 | Brucker et al. | 250/292 |
| 2002/0005479 | A1 * | 1/2002 | Yoshinari et al. | 250/288 |
| 2003/0066958 | A1 * | 4/2003 | Okumura et al. | 250/286 |
| 2003/0071206 | A1 * | 4/2003 | Belov et al. | 250/282 |
| 2003/0155498 | A1 * | 8/2003 | Kato | 250/281 |
| 2003/0189171 | A1 * | 10/2003 | Londry et al. | 250/292 |
| 2004/0069943 | A1 * | 4/2004 | Kato | 250/281 |
| 2004/0108456 | A1 * | 6/2004 | Sudakov et al. | 250/288 |
| 2004/0149903 | A1 * | 8/2004 | Wang | 250/292 |
| 2004/0222370 | A1 * | 11/2004 | Bateman et al. | 250/281 |
| 2004/0245455 | A1 * | 12/2004 | Reinhold | 250/288 |
| 2004/0262511 | A1 * | 12/2004 | Kato | 250/281 |
| 2005/0145790 | A1 * | 7/2005 | Wang | 250/292 |
| 2005/0178963 | A1 * | 8/2005 | Londry et al. | 250/293 |
| 2005/0242278 | A1 * | 11/2005 | Syage et al. | 250/284 |
| 2005/0258364 | A1 * | 11/2005 | Whitehouse et al. | 250/292 |
| 2005/0263695 | A1 * | 12/2005 | Syka | 250/291 |
| 2005/0279932 | A1 * | 12/2005 | Wang | 250/290 |
| 2006/0169884 | A1 * | 8/2006 | Syka | 250/282 |
| 2007/0084998 | A1 * | 4/2007 | Franzen et al. | 250/287 |
| 2008/0111067 | A1 * | 5/2008 | Glish et al. | 250/282 |
| 2008/0121795 | A1 * | 5/2008 | Sugiyama et al. | 250/282 |
| 2008/0191130 | A1 * | 8/2008 | Bateman et al. | 250/283 |
| 2012/0112056 | A1 | 5/2012 | Brucker et al. | |

FOREIGN PATENT DOCUMENTS

| | | | | | |
|---|---|---|---|---|---|
| CA | 2256028 | C | * | 1/2007 | |
| DE | 1448192 | | | 10/1968 | |
| DE | 1448200 | | | 10/1968 | |
| DE | 1448201 | | | 11/1968 | |
| DE | 1498873 | | | 4/1969 | |
| EP | 1 298 700 | A2 | | 4/2003 | |
| EP | 1298700 | A2 | * | 4/2003 | H01J 49/42 |
| KR | 10-2009-0010067 | | | 1/2009 | |
| WO | WO 9747025 | A1 | * | 12/1997 | H01J 49/42 |
| WO | WO 9963578 | A2 | * | 12/1999 | H01J 49/42 |
| WO | WO 2006/008537 | A2 | | 1/2006 | |
| WO | WO 2006008537 | A2 | * | 1/2006 | H01J 49/04 |
| WO | WO 2007/072038 | A2 | | 6/2007 | |
| WO | WO 2007072038 | A2 | * | 6/2007 | H01J 49/42 |
| WO | WO 2008/063497 | | | 5/2008 | |

OTHER PUBLICATIONS

Clifcorn, L.E., et al., edited by, Frank R. Fisher, "Freeze-Drying of Foods," *Proceedings of a Conference*, Advisory Board on Quartermaster Research and Development, National Academy of Sciences National Research Council (1961).

Elsey, R.J., "Outgassing of Vacuum Materials—I," Vacuum, 25(7): 299-306 (1975).

Elsey, R.J., "Outgassing of Vacuum Materials—II," Vacuum, 25(8): 347-361 (1975).

Huber, W.,K., "Partial Pressure Measurements in High and Ultra-High Vacuum Systems, Part I," *Vacuum*, 13:399-412 (1963).

Leybold, Partial Pressure Indicator Farvitron®—Operating Instructions. (no date available).

Lichtman, D., "Perspective on Residual Gas Analysis," J. Vac. Sci. Technol. A 2(2): 200-205 (1984).

Reich, G., and Flecken, F., "Analysis of Partial Pressures by means of Omegatron and Farvitron, Comparative View of the Ranges of Application" *Vacuum*, 10(1-2):35-39 (1960).

Tretner, W., "Session II—Methods of Measuring Residual Gases During the Manufacture and Life of Tubes—An Electrostatic Mass Spectroscope," pp. 31-34.

Blauth, "Dynamic mass spectrometers", Elsevier, Amsterdam, XP002503688, p. 58, last paragraph—p. 59; figure 45 (1966) (No month available).

Correa, J. R. and Ordonez, C. A., "Electrostatic Confinement of a Reflecting Ion Beam," *Non-Neutral Plasma Physics V. Workshop on Non-Neutral Plasmas*, AIP Conference Proceedings, vol. 692, pp. 246-251 (2003) (No month available).

Bhushna, K. G., et al., "A Fourier Transform Electrostatic Ion Trap for High-resolution Mass Spectrometry," *Proceedings of 12th ISMAS Symposium cum: Workshop on Mass Spectrometry, IRP-1*, 6 pp., (Mar. 25-30, 2007).

PCT International Search Report and PCT Written Opinion of the International Searching Authority, 14 pp., mailed Dec. 29, 2008.

Kouji, H., "Theory behind Farvitron Mass Spectrometer [online]," 1998, *M2*. [retrieved on Apr. 5, 2012] Retrieved from the Internet URL: www.ss.teen.setsunan.ac.jp/1996/hathene2.html. Original language of document is Japanese, Verification of Translation attached.

Kouji, H., "Design and Production of Simple Farvitron Mass Spectrometer [online]," 1998, *M2*. [retrieved on Mar. 29, 2012] Retrieved from the Internet URL: http://www.ss.teen.setsunan.ac.jp/1996/hatheme1.html. Original language of document is Japanese, Verification of Translation attached.

Sakuhin, "Sakuhin Collection 1997 [online]," [retrieved on Mar. 29, 2012] Retrieved from the Internet URL: http://www.ss.teen.setsunan.ac.jp/1997/sakuhin97.html. Original language of document is Japanese, Verification of Translation attached.

PCT Notification Concerning Transmittal of International Preliminary Report on Patentability (Chapter I of the Patent Cooperation Treaty), PCT/US2007/023834, Mailed May 19, 2009, 7 pp.

Rozanov, L.N. "Electrical Methods of Measuring Partial Pressure" In *Vacuum Technique*, Hablanian, M.H., ed. (NY: Taylor & Francis), pp. 99-109 and 320 (2002).

* cited by examiner

ELECTROSTATIC ION TRAP

RELATED APPLICATIONS

This application is the U.S. National Stage of International Application No. PCT/US2007/023834, filed Nov. 13, 2007, which designates the U.S., published in English, and claims the benefit of U.S. Provisional Application No. 60/858,544, filed Nov. 13, 2006. The entire teachings of the above applications are incorporated herein by reference.

BACKGROUND OF THE INVENTION

Several different approaches have been used in the scientific and technical literature to catalogue and compare all presently available mass spectrometry instrumentation technologies. At the most basic level, mass spectrometers can be differentiated based on whether trapping or storage of ions is required to enable mass separation and analysis. Non-trapping mass spectrometers do not trap or store ions, and ion densities do not accumulate or build up inside the device prior to mass separation and analysis. Common examples in this class are quadrupole mass filters and magnetic sector mass spectrometers in which a high power dynamic electric field or a high power magnetic field, respectively, are used to selectively stabilize the trajectories of ion beams of a single mass-to-charge (M/q) ratio. Trapping spectrometers can be subdivided into two subcategories: Dynamic Traps, such as for example the quadrupole ion traps (QIT) of Paul's design, and Static Traps, such as the electrostatic confinement traps more recently developed. Electrostatic traps that are presently available, and used for mass spectrometry, rely on harmonic potential trapping wells to ensure ion energy independent oscillations within the trap with oscillation periods related only to the mass to charge ratio of the ions. Mass analysis in some of the modern electrostatic traps has been performed through (i) use of remote, inductive pick up and sensing electronics and Fast Fourier Transform (FFT) spectral deconvolution. Alternatively, ions have been extracted, at any instant, by the rapid switching off of the high voltage trapping potentials. All ions then escape, and their mass-to-charge ratios are determined through time of flight analysis (TOFMS). Some recent developments have combined the trapping of ions with both dynamic (pseudo) and electrostatic potential fields within cylindrical trap designs. Quadrupole radial confinement fields are used to constrain ion trajectories in a radial direction while electrostatic potentials wells are used to confine ions in the axial direction with substantially harmonic oscillatory motions. Resonant excitation of the ion motion in the axial direction is then used to effect mass-selective ion ejection.

SUMMARY OF THE INVENTION

The present invention relates to a design and operation of an electrostatic ion trap that confines ions of different mass-to-charge (M/q) ratios and kinetic energies within an anharmonic potential well. The ion trap is also provided with a small amplitude AC drive that excites confined ions. The mass dependent amplitudes of oscillation of the confined ions are increased as their energies increase, due to an autoresonance between the AC drive frequency and the natural oscillation frequencies of the ions, until the oscillation amplitudes of the ions exceed the physical dimensions of the trap, or the ions fragment or undergo any other physical or chemical transformation. Trajectories of the ions can run in close proximity to and along an ion confinement axis. The ion trap can be cylindrically symmetric about a trap axis and the ion confinement axis can be substantially coincident with the trap axis.

The ion trap can include two opposed mirror electrode structures and a central lens electrode structure. The mirror electrode structures can be composed of cups or plates with on-axis or off-axis apertures or combinations thereof. The central lens electrode structure can be a plate with an axially located aperture or an open cylinder. The two mirror electrode structures can be biased unequally.

The ion trap can be provided with a scan control system that reduces the frequency difference between the AC excitation frequency and the natural oscillation frequency of the ions, either by scanning the AC excitation frequency, for example, from a frequency higher than the natural oscillation frequency of the ions to a frequency lower than the natural oscillation frequency of the ions of interest, or by scanning the bias voltage applied to the central lens electrode of the ion trap, for example, from a bias voltage that is sufficient to confine the ions of interest to a bias voltage of a larger absolute magnitude. The amplitude of the AC excitation frequency can be smaller than the absolute magnitude of the bias voltage applied to the central lens electrode, by at least three orders of magnitude, and larger than a threshold amplitude. The sweep rate of scanning the AC excitation frequency can be decreased as the drive frequency decreases.

The natural oscillation frequency of the lightest ions confined in the ion trap can, for example, be between about 0.5 MHz and about 5 MHz. The confined ions can have a plurality of mass to charge ratios and a plurality of energies.

The ion trap can be provided with an ion source to form an ion beam source. The ion trap can also be provided with an ion detector to form a plasma ion mass spectrometer, and, with the addition of an ion source, the ion trap can be configured as a mass spectrometer. The ion source can be an electron impact ionization ion source. The ion detector can contain an electron multiplier device. The ion detector can be positioned off axis with respect to the linear axis of the ion trap. The ion source can be operated continuously while the drive frequency is scanned, or the ions can be generated in a time period immediately preceding the start of the drive frequency scan.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

Figure 1:
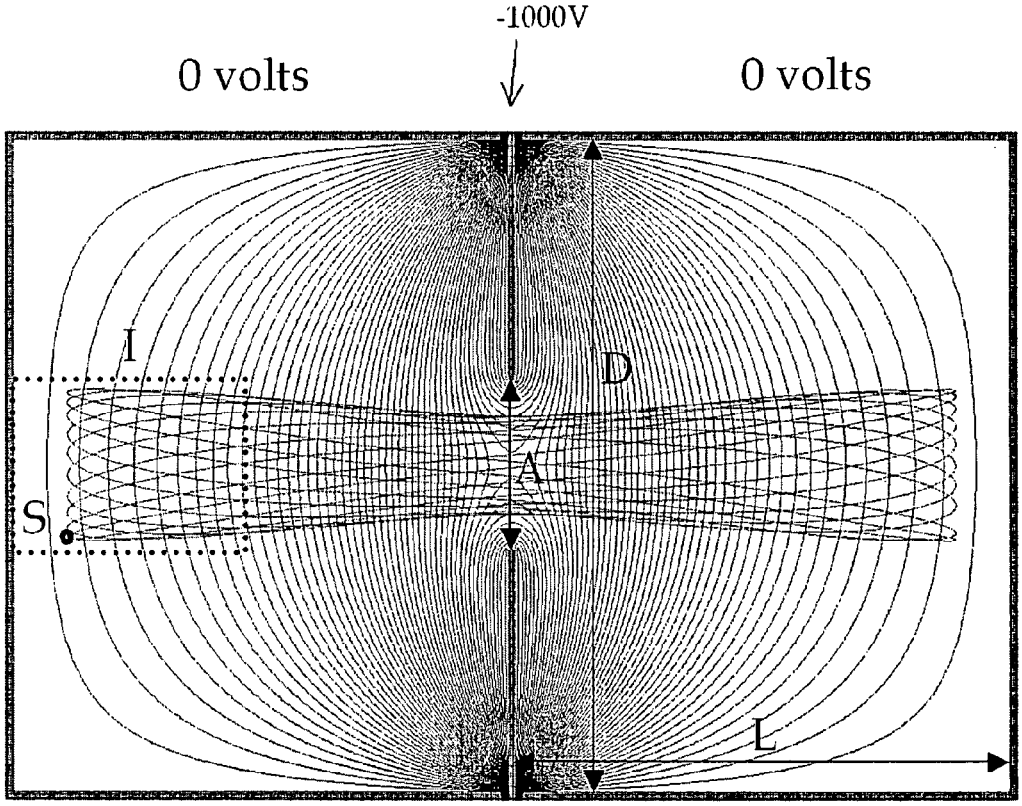
FIG. 1 is a computer generated representation of an ion trajectory simulation of a short electrostatic ion trap.

A description of example embodiments of the invention follows.

The teachings of all patents, published applications and references cited herein are incorporated by reference in their entirety.

An electrostatic ion trap traps ions within an anharmonic potential and a ion-energy excitation mechanism based on the application of a low-amplitude AC drive and autoresonance phenomena. The electrostatic ion trap is connected to a small amplitude AC drive. The electrostatic ion trap energizes ionized molecules based on the principles of autoresonant excitation. In one embodiment, the system can be configured as a pulsed, mass-selective ion-beam source that emits ions of pre-selected mass-to-charge ratio (M/q) based on the principles of autoresonant excitation of ion energies in a purely electrostatic trap connected to an AC drive. In another embodiment, the system can be configured as a mass spectrometer that separates and detects ionized analyte molecules based on the principles of autoresonant excitation in a purely electrostatic trap connected to an AC drive.

Unlike electrostatic ion traps of the prior art, the design relies on the strong anharmonicity of the axial trapping potential wells (i.e. nonlinear electrostatic fields) in purely electrostatic traps of small dimensions. The energy of ions, undergoing nonlinear oscillatory motion along the axis, is intentionally pumped up by an AC drive through controlled changes in trap conditions. A general phenomenon of nonlinear oscillatory systems, previously defined in the scientific literature as autoresonance, is responsible for the excitation of the ion's oscillatory motion. Changes in trap conditions include, but are not limited to, changes in the frequency drive (i.e. frequency scans) under fixed electrostatic trapping conditions, or changes in trapping voltages (i.e. voltage scans) under fixed drive frequency conditions. Typical AC drives include, but are not strictly limited to, electrical RF voltages (typical), electromagnetic radiation fields and oscillatory magnetic fields. Within this methodology, the drive strength must exceed a threshold for persistent autoresonance to be established.

Electrostatic Ion Trap

By definition, a purely electrostatic ion trap utilizes exclusively electrostatic potentials for confinement of the ion beam. The basic principle of operation of a purely electrostatic ion trap is analogous to that of an optical resonator and has been previously described in the scientific literature, for example, in H. B. Pedersen et. al., Physical Review Letters, 87(5) (2001) 055001 and Physical Review A, 65 (2002)

042703. Two electrostatic mirrors, i.e. first and second electrode structures, placed on either side of a linear space define a resonant cavity. A properly biased electrostatic lens assembly, i.e. lens electrode structure, placed at a central location between the two mirrors, provides (1) the electrical potential bias required to confine the ions axially in a purely electrostatic and anharmonic potential well and (2) the radial focusing field required to confine the ions radially. The ions trapped within the axial anharmonic potential well reflect repeatedly between the electrostatic mirrors in an oscillatory motion. In its most typical implementation, an electrostatic ion trap has cylindrical symmetry, with ion oscillations taking place in near parallel lines along the axis of symmetry, as described in Schmidt, H. T.; Cederquist, H.; Jensen, J.; Fardi, A., "Conetrap: A compact electrostatic ion trap", Nuclear Instruments and Methods in Physics Research Section B, Volume 173, Issue 4, p. 523-527. The electrode structures are carefully selected and designed to equalize travel times (i.e. oscillation periods) for all ions of a common mass-to-charge ratio.

Prior art electrostatic ion traps, used in several designs of time-of-flight mass spectrometers, were relatively long (tens of centimeters), relied on harmonic electrostatic trapping potentials, used pulsing of the inlet and exit electrostatic mirror potentials to effect injection and ejection of ions and sometimes performed an FFT analysis of induced image charge transients to produce mass spectral output based on the mass dependent oscillation times of the trapped ions, as described in Daniel Zajfman et. al., U.S. Pat. No. 6,744,042 B2 (Jun. 1, 2004) and Marc Gonin, U.S. Pat. No. 6,888,130 B1 (May 3, 2005).

In contrast, the novel trap of this invention (i.e. new art) is (1) short (less than 5 cm, typically), (2) relies on anharmonic potentials to axially confine the ions, (3) uses a low amplitude AC drive to produce ion energy excitation. Radial confinement of the ion beam in the electrostatic ion trap is achieved by purely electrostatic means providing a clear differentiation from linear ion traps in the prior art that rely on AC or RF voltages to radially confine at least some of the ions within an ion guide or an ion trap, as, for example, described in Martin R. Green et. al., Characterization of mass selective axial ejection from a linear ion trap with superimposed axial quadratic potential, http://www.waters.com/WatersDivision/SiteSearch/AppLibDetails.asp?LibNum=72000 2210EN (last visited Nov. 9, 2007).

As shown in our preferred trap embodiment, FIG. 1, the implementation of a short electrostatic ion trap can be very simple using only two grounded round cups (diameter D and length L) as the first and second electrode structures and a single plate with an aperture (diameter A) as the lens electrode structure. A single negative DC potential, $-U_{trap}$ is applied to the aperture plate to confine positive-ion beams. It is possible to choose specific proportions, between the diameters and lengths of the electrodes, such that the trap requires only one independently biased electrode (i.e. all other electrodes can be kept at ground potential).

We have shown, through SIMION simulations, that the ion trajectories are stable if the cup's length L is between D/2 and D. In that case, the ions, created anywhere inside the volume I (i.e. with diameter A and length L/2, marked by the dotted lines) will oscillate indefinitely inside this trap. The horizontal lines represent the trajectory of a single trapped positive ion, which was created at the point marked by the circle S. The other lines (mostly vertical) are the equipotentials at 20V intervals. Effective radial focusing is evidenced by a waist in the ion beam at the lens aperture. Confinement of negative ions is also possible within this same trap by simply switching polarity of the trapping potential to a positive value, $+U_{trap}$.

A very important advantage of an electrostatic ion trap design with a single biased electrode is its ability to easily switch between positive and negative ion beam confinement operational modes, by simply switching the polarity of a single DC trapping potential bias and with very little burden on the complexity of the electronics design requirements.

Even though the electrodes in FIG. 1 are described as solid metal plates, it will also be possible to design further embodiments in which the metal plate material is replaced with grid material or perforated metal plates.

Even though most of the prototypes of electrostatic ion traps that were tested in our lab relied on conductive materials (i.e. metal plates, cups and grids) for the construction of electrodes, it will be well understood by those skilled in the art that non-conductive materials will also be useful as substrates to manufacture electrodes as long as continuous and/or discontinuous coatings of conductive materials are also deposited on their surfaces to produce tailored and optimized electrostatic trap potentials and geometries. Non-conductive plates, cups and grids can be coated with uniform or non-uniform resistive materials such that application of voltages results in the desired axial and radial ion confinement potentials. Alternatively, it will also be possible to coat or plate non-conductive surfaces with a plurality of uniquely designed electrodes, and wherein the electrodes can be disposed on the plate and cup surfaces and biased individually or in groups to provide optimized trapping electrostatic potentials. Such electrode design will provide the same advantages that have recently been realized for standard quadrupole ion traps while using a multiplicity of conductive electrodes to create virtual traps with relaxed mechanical requirements, as described in Edgard D. Lee et. al. U.S. Pat. No. 7,227,138. The flexibility provided by a large number of closely spaced electrodes, and the different ways to mechanically arrange them (count, size and spacing) and electrically bias them (individually or in groups) provides excellent means not only to improve the performance of traps but also to provide field corrections due to aging and mechanical misalignments.

The choice of construction materials for electrostatic ion trap manufacturing will be dictated by the application requirements and chemical composition of the gaseous substances coming in contact with the trap structures. It will be necessary to consider coatings, ceramic substrates, metal alloys, etc., to adapt to different sampling requirements and conditions. The simplicity of the novel trap design increases the chances of finding alternative construction materials as needed to adapt to new applications. It will also be necessary to consider coatings for the trap electrodes specifically selected to minimize cross contamination, corrosion, self-sputtering and chemical degradation under continuous operation.

It is also possible to construct further embodiments for electrostatic traps relying exclusively, or in part, on resistive glass material construction, such as FieldMaster Ion Guides/Drift tubes manufactured by Burle Industries, Inc, as described in Bruce LaPrade, U.S. Pat. No. 7,081,618. Using glass material with non-uniform electrical resistivity will provide the ability to tailor both axial and radial electric fields inside the trap to produce more efficient anharmonic field trapping, radial confinement and energy pumping conditions.

Notice that though most of the embodiments implemented in our lab relied on ion traps of an open design (i.e. with free flow of gas molecules in and out of the trap volume), it is also possible to construct embodiments in which it might be necessary to seal or isolate the trap's internal volume. In this case, molecules and/or atoms could be injected directly into the trap volume without any molecular exchange with gas species from outside. A closed configuration will be preferred for differentially pumped sampling setups (i.e. with pressure inside the trap lower than process pressure and with electrons and/or analyte molecules brought in through low conductance apertures). A closed trap configuration will also be useful in applications requiring cooling, dissociating, cleaning or reactive gases to be introduced into the trap to effect cooling, cleaning, reaction, dissociation or ionization/neutralization. A closed configuration will also be advantageous in applications requiring a way to rapidly purge the trap volume of analyte molecules between mass spectrometry scans—i.e. gas line delivering cold or hot, inert or dry gas could be used to clean the trap between analyses preventing/minimizing cross contamination, reactivity and false readings. For the remainder of this document, electrostatic ion traps will be described as open traps if their geometrical design and electrode configuration allows full exchange of gas molecules with the rest of the vacuum system, and closed traps if the internal volume of the trap is isolated or has a restricted gas conductance path to the rest of the system.

The development and construction of small profile, miniaturized electrostatic ion traps is mechanically feasible and the benefits of miniaturization will be apparent to those skilled in the art. Miniature ion traps, manufactured through MEMS methodologies will very likely find application in high pressure sampling during mass spectral analysis.

Even though compactness is considered an intrinsic advantage of this new anharmonic electrostatic trap for the implementation of field portable and low power consumption devices, there may be applications in which larger traps might be desirable to perform certain specialized analyses or experiments. The operational principles set forth in this invention are not strictly limited to traps of small dimensions. The same concepts and principles of operation can be extrapolated to traps of larger dimensions without any change in functionality. Autoresonant excitation may be incorporated into traps used for TOF measurements and relying on additional phenomena such as ion bunching for synchronicity, as described in L. H. Andersen et. al., J. Phys. B:At. Mol. Opt. Phys. 37 (2004) R57-R88.

The trap designs described above were clearly presented for reference only and it will be understood by those skilled in the art that various changes in form and detail maybe made to the basic design without departing from the scope of the present invention.

Anharmonic Oscillation

By definition, a harmonic oscillator is a system which, when displaced from its equilibrium position, experiences a restoring force proportional to the displacement (i.e. according to Hooke's law). If the linear restoring force is the only force acting on the system, the system is called a simple harmonic oscillator, and it undergoes simple harmonic motion: sinusoidal oscillations about the equilibrium point, with constant frequency which does not depend on amplitude (or energy). In the most general terms, anharmonicity is simply defined as the deviation of a system from being a harmonic oscillator, i.e. an oscillator that is not oscillating in simple harmonic motion is known as an anharmonic or nonlinear oscillator.

Figure 2A:
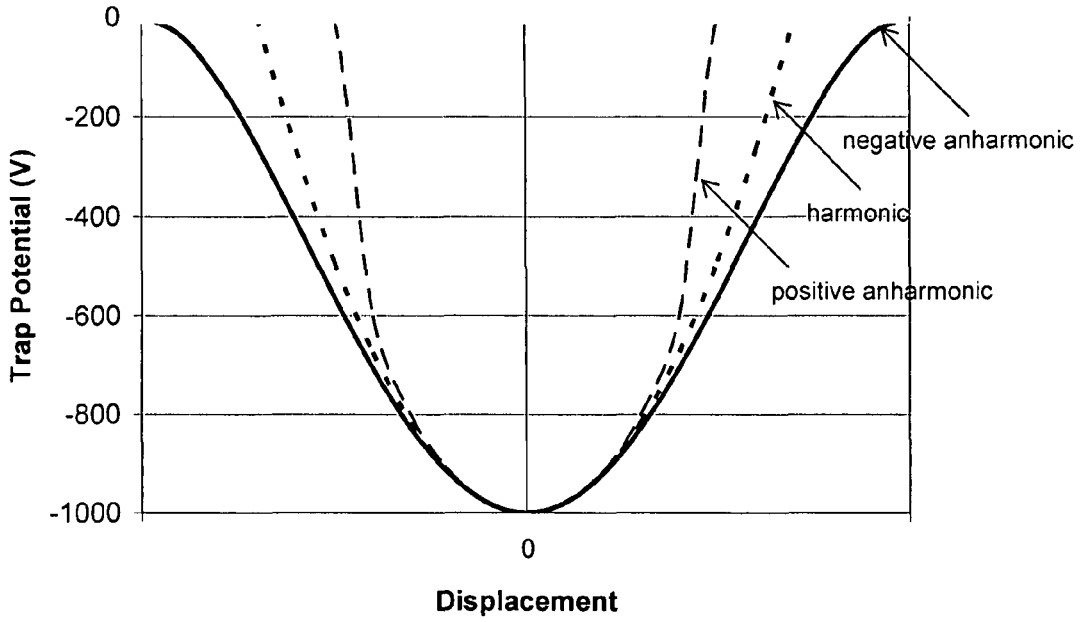
FIG. 2A is a drawing of the ion potential energy vs. position along the ion trap axis in a short electrostatic ion trap showing positive anharmonic, harmonic, and negative anharmonic potentials.

Electrostatic ion traps of the prior art relied on carefully specified and substantially harmonic potential wells to trap ions, measure mass-to-charge ratios (M/q) and determine sample compositions. A typical harmonic electrostatic potential well is graphically depicted as a dotted line in FIG. 2A. Harmonic oscillations in the quadratic potential well defined by the dotted curve in FIG. 2A are independent of the amplitude of the oscillation and energy of the ions. Ions trapped in a harmonic potential experience linear fields and undergo simple harmonic motion oscillating at a fixed natural frequency depending only on the mass-to-charge ratio of the ions and the specific shape of the quadratic potential well (which is defined by the combination of the trap geometry and the magnitude of the electrostatic voltages.) The natural frequency for a given ion is not affected by its energy or the amplitude of oscillation and there is a strict relationship between natural frequency of oscillation and square-root of mass-to-charge ratio, i.e. ions with a larger mass-to-charge ratio oscillate at a lower natural frequency than ions with a smaller mass-to-charge ratio. High-tolerance mechanical assemblies are generally required to establish carefully selected harmonic potential wells, self-bunching, isochronous oscillations and high resolution spectral output for both inductive pickup (FTMS) and TOF detection schemes. Any anharmonicity in the electrostatic potential of prior-art electrostatic traps degrades their performance, and has generally been regarded as an undesirable feature in an electrostatic ion trap.

In complete contrast to prior traps, our trap utilizes strong anharmonicity in the ion oscillatory motion as a means for (1) ion trapping and also for (2) mass-selective autoresonant excitation and ejection of ions. The ion potential vs. displacement along the ion trap axis for a typical electrostatic ion trap of this invention is depicted by the solid curve in FIG. 2A. The natural frequency of oscillation of an ion in such a potential well depends on the amplitude of oscillation and results in anharmonic oscillatory motion. This means that the natural oscillation frequency of a specific ion trapped in such potential well is determined by four factors: (1) the details of the trap geometry, (2) the ion's mass-to-charge ratio (M/q), (3) the ion's instantaneous amplitude of oscillation (related to its energy) and (4) the depth of the potential trap defined by the voltage gradient established between the end cap electrodes and the lens electrode. In a non-linear axial field as depicted by the solid curve in FIG. 2A, the ions with larger oscillation amplitudes have lower oscillation frequencies than same mass ions with smaller oscillation amplitudes. In other words, trapped ions will experience a decrease in oscillation frequency and an increase in oscillation amplitude if their energy increases (i.e. anharmonic oscillations)

Figure 2B:
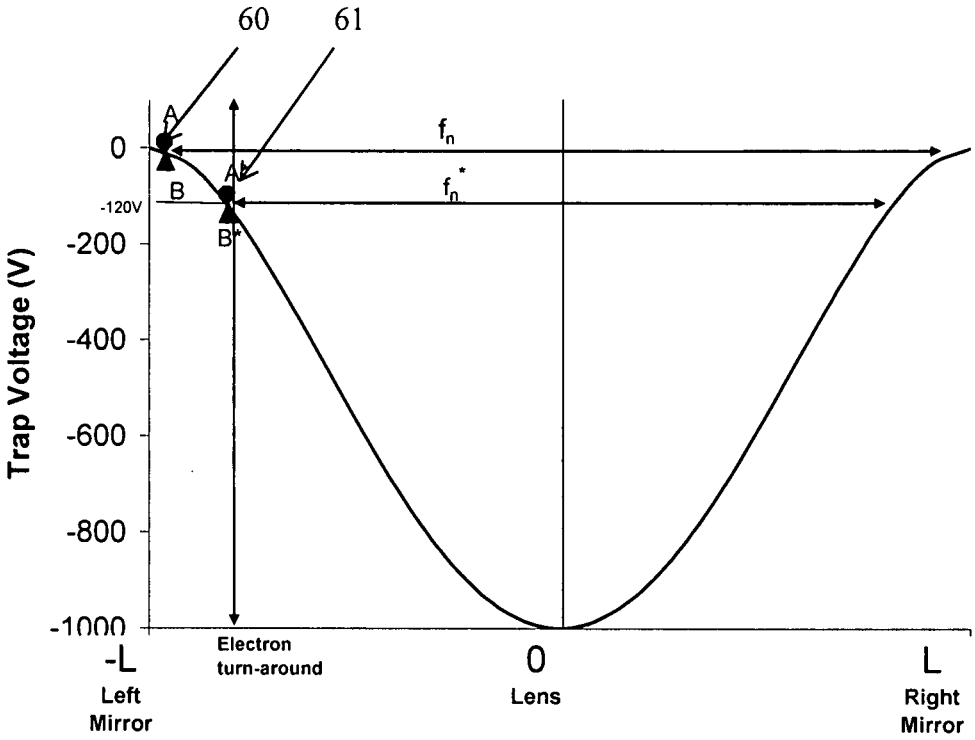
FIG. 2B is a drawing of the relative positions of ions of different energies and different natural frequencies of oscillation in an anharmonic potential

The solid curve in FIGS. 2A and 2B depicts an anharmonic potential with a negative nonlinearity sign as it is typically encountered in most of the preferred trap embodiments of the present invention. Ion oscillation in this sort of anharmonic potential trap will experience increasing oscillation trajectories and decreasing frequencies as they gain energy, for example through autoresonance, as described in the following section. However, this invention is not strictly limited to traps with anharmonic potentials with negative deviations from linearity. It is also possible to construct electrostatic traps with positive deviations from harmonic (i.e. quadratic) potentials in which case the changes in trap conditions required to effect autoresonance will be reversed from those required for negatively deviated potentials. A positive deviation in trapping potential from a harmonic potential curve is illustrated by the dashed line in FIG. 2A. Such a potential is also responsible for anharmonic oscillations of the ions, but with opposite relationships between ion energy and oscillation frequency as compared to the solid curve. It is possible to use positively deviated potentials in anharmonic traps in order to achieve specific relationships between ion energy and oscillation frequencies that might lead to improved fragmentation rates under autoresonance.

Since the electrostatic ion trap of this invention uses anharmonic potentials to confine ions in an oscillatory motion, fabrication requirements are much less complex and machining tolerances much less stringent than in prior art electrostatic traps where strict linear fields were a requirement. The performance of the new trap is not dependent upon a strict or unique functional form for the anharmonic potential. Whereas the presence of strong anharmonicity in the potential trapping well is a basic prerequisite for ion excitation through autoresonance, there are no strict or unique requirements or conditions to meet in terms of the exact functional form of the trapping potentials present inside the trap. In addition, mass spectrometry or ion-beam sourcing performance is also less sensitive to unit-to-unit variations allowing more relaxed manufacturing requirements for an autoresonant trap mass spectrometer (ART MS) compared to any other prior art mass spectrometry technology.

The anharmonic potential depicted in the solid curve of FIG. 2A is clearly presented for reference only and it will be understood by those skilled in the art that various changes in form and detail maybe made to the anharmonic potential without departing from the scope of the present invention.

Autoresonance

Autoresonance is a persisting phase-locking phenomenon that occurs when the driving frequency of an excited nonlinear oscillator slowly varies with time, as described in Lazar Friedland, Proc. Of the Symposium: PhysCon 2005 (invited), St. Petersburg, Russia (2005), and J. Fajans and L. Friedland, Am. J. Phys. 69(10) (2001) 1096. With phase-lock, the frequency of the oscillator will lock to and follow the drive frequency. That is, the nonlinear oscillator will automatically resonate with the drive frequency.

In this regime, the resonant excitation is continuous and unaffected by the oscillator's nonlinearity. Autoresonance is observed in nonlinear oscillators driven by relatively small external forces, almost periodic with time. If the small force is exactly periodic, the small growth in oscillation amplitude is counteracted by the frequency nonlinearity—phase-locking causes the amplitude to vary with time. If instead the driving frequency is slowly varying with time (in the right direction determined by the nonlinearity sign), the oscillator can remain phase-locked but on average increases its amplitude with time. This leads to a continuous resonant excitation process without the need for feedback. The long time phase-lock with the perturbation leads to a strong increase in the response amplitude even under a small driving parameter.

Autoresonance has found many applications in physics, particularly in the context of relativistic particle accelerators. Additional applications have included excitation of atoms and molecules, nonlinear waves, solutions, vortices and dicotron modes in pure electron plasmas, as described in J. Fajans, et. al., Physical Review E 62(3) (2000) PRE62. Autoresonance has been observed in systems with both external and parametrically driven oscillations, for both damped and undamped oscillators and at drive frequencies including fundamental, subharmonics and superharmonics of the natural oscillatory motion. To the best of our knowledge, autoresonance phenomena have not been linked to, or discussed in connection with, any purely electrostatic ion trap, pulsed ion beam or mass spectrometer. Autoresonance phenomena have not been used to enable or optimize the operation of any known prior art mass spectrometer.

The theoretical framework describing autoresonance phenomena, particularly in the presence of damping, has only recently been fully derived and experimentally verified, as described in J. Fajans, et. al. Physics of Plasmas 8(2) (2001) p. 423. As a general rule, the drive strength is observed to be related to the frequency sweep rate. The drive strength must exceed a threshold proportional to the sweep rate raised to the ¾ power. This threshold relationship was only recently discovered and holds for a very broad class of driven nonlinear oscillators.

Autoresonant Energy Excitation

In a typical electrostatic ion trap of the present invention autoresonant excitation of a group of ions of given mass-to-charge ratio, M/q, is achieved in the following fashion:

1. ions are electrostatically trapped and undergo nonlinear oscillations within the anharmonic potential with a natural oscillation frequency, $f_M$,
2. an AC drive is connected to the system with an initial drive frequency, $f_d$, above the natural oscillation frequency of the ions: $f_d > f_M$,
3. continuously reducing the positive frequency difference between the drive frequency, $f_d$, and the natural oscillation frequency of the ions, $f_M$, until the instantaneous frequency difference approaches nearly zero, causes the oscillatory motion of the ions to phase-lock into persistent autoresonance with the drive. (In a autoresonant oscillator, the ions will then automatically adjust their instantaneous amplitude of oscillation by extracting energy from the drive and as needed to keep their natural oscillation frequency phase-locked to the drive frequency.),
4. further attempts to change trap conditions towards a negative difference between the drive frequency and the natural oscillation frequency of the ions then results in energy being transferred from the AC drive into the oscillatory system changing the oscillatory amplitude and frequency of oscillation of the ions, and
5. for a typical electrostatic ion trap with a potential such as depicted in FIG. 2. (negative nonlinearity) the oscillatory amplitudes become larger and the ions oscillate closer to the end plates as energy is transferred from the drive into the oscillatory system. Eventually, the oscillation amplitude of the ions will reach a point where it either hits a side electrode, or leaves the trap if a side electrode is semi transparent (a mesh).

The autoresonant excitation process described above can be used to 1) excite ions causing them to undergo new chemical and physical process while stored, and/or 2) eject ions from the trap in a mass selective fashion. Ion ejection can be used to operate pulsed ion sources as well as to implement full mass spectrometry detection systems, in which case a detection method is required to detect the autoresonance events and/or the ejected ions.

Autoresonant Ejection

As described in the previous section, autoresonant excitation of ion energies in an electrostatic trap with an anharmonic potential such as in FIG. 2B can be used to effect mass-selective ejection of ions from a purely electrostatic trap. Autoresonance conditions can be achieved by a number of different means. The two basic modes of operation used for autoresonant ejection of ions from electrostatic traps are described in this section for the preferred embodiment of FIG. 3 which is based on the preferred trap embodiment of FIG. 1 and which features trapping potentials along the z-axis that can be generically represented by the solid curve of FIG. 2B.

Figure 3:
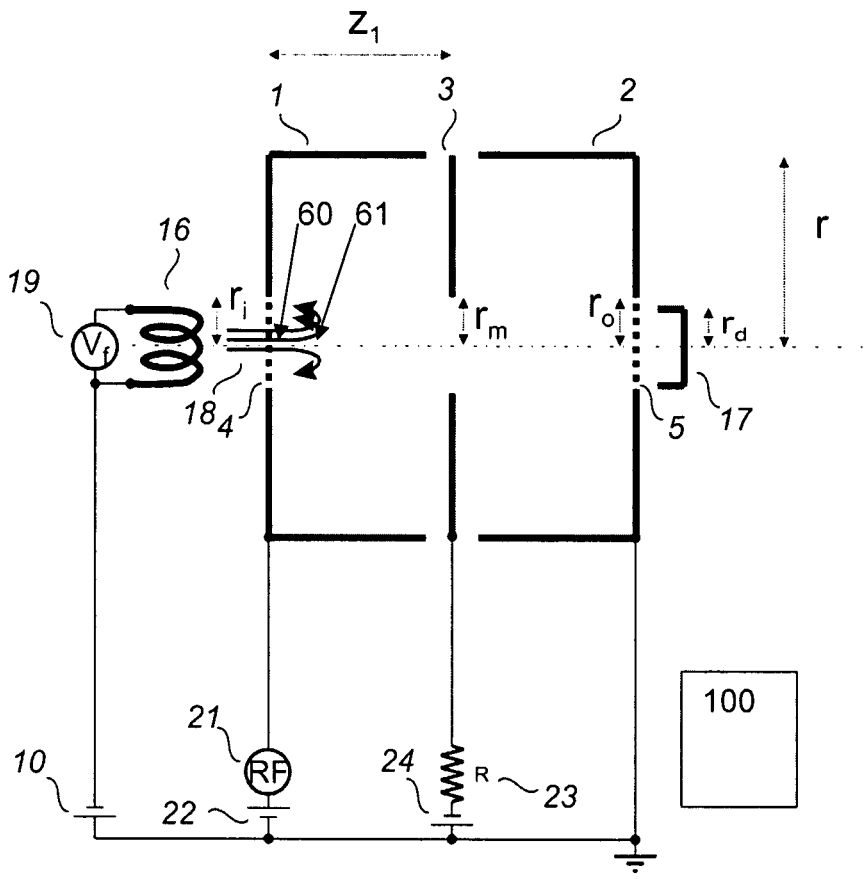
FIG. 3 is a schematic diagram of a mass spectrometer based on an anharmonic electrostatic ion trap with autoresonant ejection of ions.

In a preferred embodiment of a mass spectrometer, shown in FIG. 3, an electrostatic ion trap comprises cylindrically symmetric cup electrodes, 1 and 2, each being open toward a planar aperture trap electrode 3 located centrally on the cylindrical linear axis of the ion trap and midway between electrodes 1 and 2. The middle electrode, 3, has an axial aperture of radius $r_m$. Electrodes 1 and 2 have an internal radius r. Electrodes 1 and 2 define the full lateral extent of the trap in the z direction, $2 \times Z_1$. Electrodes 1 and 2 have axial apertures, 4 and 5, of respective radii $r_i$ and $r_o$ that are filled with semi-transparent conducting mesh. The mesh within aperture 4 in electrode 1 allows transmission of electrons from a hot filament 16 into the trap. Electrons emanating from the filament 16 follow electron trajectories 18 reaching into the trap between electrodes 1 and 3 before leaving the trap. Maximum electron energies are set by the filament bias supply 10. Electron emission currents are controlled through adjustments of the filament power supply 19. Gaseous species within the trap are subject to electron impact and a small fraction of the gaseous species are ionized. Resulting positive ions are initially confined within the trap between electrodes 1, 2 and 3. Along the z axis the ions move within an anharmonic potential field. The potentials within the trap are made slightly asymmetric about the middle electrode 3 by application of a small DC bias $U_i$ through the offset supply 22 applied to electrode 1. Electrode 2 in this embodiment is grounded. The strong negative DC trapping potential, $U_m$, on electrode 3 is applied though the trap bias supply 24. In addition to the DC potentials a small RF potential, $V_{RF}$ peak-to-peak, from a programmable frequency RF supply 21 is applied to the outer electrode 1. The trap design is symmetric with respect to the middle electrode 3 and the capacitive coupling between electrodes 1 and 3 is identical to that between electrodes 3 and 2. RF potentials on electrode 3 are resistively decoupled from the trap bias supply 24, through the resistance R, 23. Thus, one half of the applied RF potential on electrode 1 is picked up on the middle electrode 3, and the RF field amplitude varies smoothly and symmetrically along the central axis from electron transmission mesh located in aperture 4 to the ion ejection mesh located in aperture 5.

For this preferred embodiment, electrons emanating from the filament 16 follow electron trajectories 18 reaching into the trap between electrodes 1 and 3 before leaving the trap typically. The ionizing electrons enter the trap at port 4 with maximum kinetic energy, defined by the difference in voltage between the filament bias 10 and electrode bias 1. The negative electrons then decelerate as they progress into the negatively biased trap and ultimately turn around as they reach negative voltage equipotentials that match the bias voltage 10 of the filament. Electron kinetic energy is at its maximum at the entrance port 4 and decreases to zero at the turn around point. It is clear that ions are only formed in the narrow volume sampled by the electrons during their brief trajectories in-and-out of the trap, by electron impact ionization, and through a wide range of impact energies. FIG. 2B depicts the original position of ions formed close to port 4, 60, and formed close to the turn around point, 61. The origination points, 60 and 61, for ions are also depicted in FIG. 3 for reference. FIG. 2B illustrates the fact that ions are formed in a wide band close to the entrance port 4, with a wide range of original potential energies and geometrical locations. For example ions formed at location 60 will have initial potential energies much higher than ions formed in position 61. As a result, ions of a particular mass-to-charge ratio formed at position 61 will oscillate at higher natural frequencies than ions of same mass-to-charge ratio formed at position 60 (anharmonic oscillation). All ions originally formed at a particular position in the trap will have the same potential energy for oscillation regardless of their mass-to-charge ratios, but will oscillate at natural frequencies which will be related to the square root of their mass-to-charge ratios. For example, ions A and B, with mass-to-charge ratios $M_A$ and $M_B$, formed at position 60, will originate with the same kinetic energy, but will oscillate with different natural frequencies that will be inversely proportional to the square root of their masses, with lighter ions having higher natural frequencies of oscillation than heavier ions. Such a wide spread of origination energies and locations for ion formation would not be tolerated in harmonic ion traps, relying on resonant ejection of ions, fast Fourier transform (FFT) analysis of induced signals or time-of-flight (TOF) measurements, since it would lead to severe degradation of mass spectral resolution during resonant excitation or TOF ejection. This internal ionization method is also very different from the typical ionization schemes used to deliver ions with low energies and tight energy distributions into ion traps relying on multipole fields for radial confinement and shallow potential wells (typically around 15V in depth) for axial trapping. It will become evident that autoresonance excitation does not only enable the efficient mass-selective ejection of ions from anharmonic traps using small AC drives, but also enables the synchronous ejection of ions with high mass spectral resolution even in the presence of large differences in ion origination position and large differences in energy among ions with the same mass to charge ratio. This effect will be described below as an energy bunching mechanism.

In the first, and preferred, mode of operation, by the application of a small oscillating RF potential 21, to one of the side trap electrodes 1 with almost the same frequency as the natural oscillation frequency of a trapped ion, the ion energy will be pumped up (or pumped down) until it oscillates with exactly the same frequency, $f_d$, as the applied AC/RF potential, $V_{AC/RF}$. Now, if the applied frequency is subsequently ramped down, the ion will oscillate with an ever-increasing amplitude due to the anharmonic field (FIG. 2B), while remaining phase-locked with the applied frequency. This implies that by simply ramping the RF frequency, $f_d$, down we can cause all ions with same mass-to-charge ratio (M/q) to leave the trap in synchronicity, irrespective of when or where the ions were initially generated within the ionization region. There is a one-to-one mapping between mass and frequency: each M/q has its unique $f_M$. Once the ions leave the trap they can be detected by an appropriate detector 17 such as an electron multiplier as required to produce a mass spectrum or can simply be directed wherever they are needed, as required from a pulsed ion beam source. Many M/q values will contribute to a typical mass spectrum. For a given middle electrode potential $U_m$ the RF frequencies for emergent ions, $f_M$, will follow a $f_M \alpha$ sqrt M/q dependence. Under typical operation conditions the driving frequency is ramped non-linearly with time in an effort to equalize the number of RF cycles utilized in ejection of a single M/q unit. In addition the RF frequency is always ramped from high to low frequencies and over a range that is sufficiently wide to eject all M/q ions from the trap after every ramp cycle. The control systems required to ramp the AC drive, $f_d$, and to eject ions are generically represented by 100 in FIG. 3 and in every embodiment below. The requirements for such a controller will be apparent to those skilled in the art.

As shown in FIG. 2B, assuming a drive frequency approaching the natural frequency of oscillation of the ions A and A* (i.e. with same mass but slightly different origination energies), it is believed that as the drive frequency decreases, ions A*, created at point 61 in FIG. 3 (higher natural oscillation frequency), will lock into autoresonance with the drive frequency before ions A, created at point 60 in FIG. 3 (lower natural oscillation frequency). As the drive frequency continues to drop, the ions A* will start to get pumped up in energy by autoresonance, getting closer in energy to the A ions, and before all ions of mass $M_A$ are finally ejected from the trap together as a bunch. This phenomenon effectively bunches up the energies of ions of common mass-to-charge ratio during excitation and assures they are all ejected at about the same time once their collective energy reaches the point at which the displacements of the ions force them out of the trap (i.e. mass-selective ejection). As the drive frequency continues to drop, the heavier ions B*, with a lower natural frequency of oscillation, will start to get pumped up in energy by autoresonance, getting closer in energy to the B ions, and before all $M_B$ ions are ejected from the trap together as a separate bunch. This energy bunching effect is not present in harmonic oscillators pumped resonantly (because natural oscillation frequencies in harmonic oscillators are energy independent), and is one reason why energetically pure ions are required for the operation of electrostatic traps with resonant excitation.

It should be noted at this point that, depending on the proximity in mass-to-charge ratio between the $M_A$ and $M_B$ ions and depending on the operational conditions of the trap (i.e. including pressure, excitation and ionization conditions), the higher energy $M_B$ ions (i.e. B*) could phase-lock with the AC drive, and start to get excited through autoresonance, before all $M_A$ ions are bunched up and ejected from the trap. In other words, at any instant during the drive frequency sweep there are probably some or many ions, of any specific M/q that are being excited through autoresonance and climbing up the potential curve. The extent of the overlap of autoresonant excitation across adjacent masses during frequency sweeps will depend on parameters such as pressure, ionization conditions, mass range and trap operation conditions. However, even though excitation is not necessarily single-mass-selective, it is apparent from the experimental results presented in this section that mass selective ejection, with adequate mass resolution, can generally be achieved in anharmonic electrostatic traps through proper adjustment of trap and drive parameters and for most typical mass ranges of analytical interest.

Figure 4A:
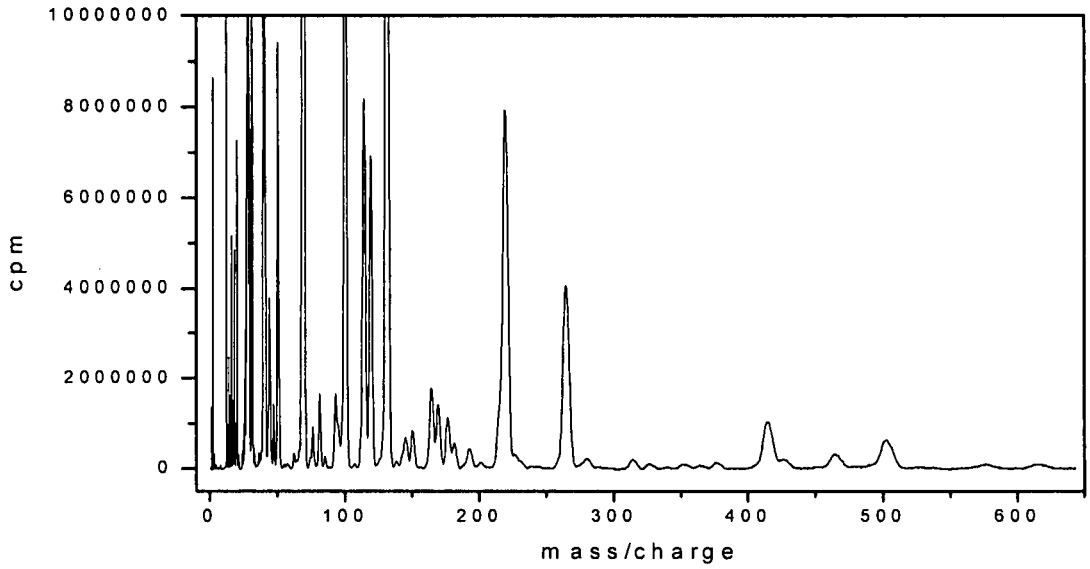
FIGS. 4A and 4B are drawings of mass spectra from residual gases at $10^{-7}$ Torr. PFTBA spectrum at $1\times10^{-7}$ Torr. RF=50 $mV_{p\text{-}p}$. Rep. Rate=15 Hz, $I_c$=10 μA, $U_e$=100 V. The spectrum was taken with an electrostatic ion trap mass spectrometer as shown in FIG. 3. Scaling factors: Top×10, Bottom×1.
Figure 4B:
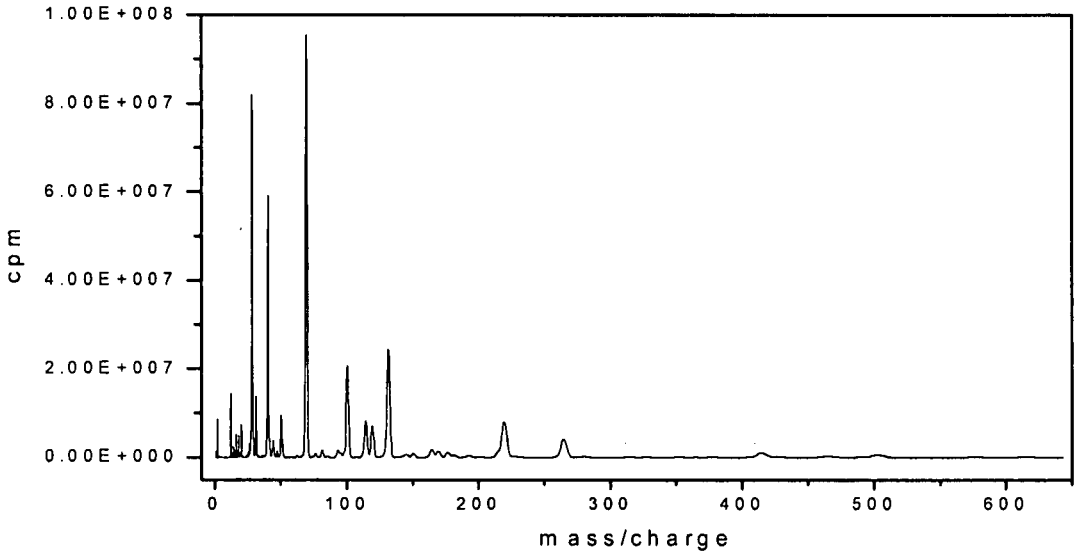

Mass spectra from residual gases at $1\cdot10^{-7}$ Torr is shown in FIG. 4. The spectra are taken with an electrostatic ion trap mass spectrometer as shown in FIG. 3. Dimensions of the ion trap were: $Z_1$=8 mm, r=6 mm, $r_m$=1.5 mm, $r_i$=3 mm, $r_m$=3 mm, $r_o$=3 mm and $r_d$=3 mm. Resistor R was 100 kOhm. The ion trap potential was −500V, the applied RF amplitude was 50 mV, a 2V DC offset was used in order to prevent ions from leaving the trap from the ionizer side, a 10 μA electron current employed, and with 100 eV maximum electron energy. The RF frequency, $f_D$, was ramped at 15 Hz between 4.5 MHz and 0.128 MHz. The spectra of FIG. 4 show a resolution M/ΔM~60. This value is typical for a wide range of operating parameters, for total pressures in the range $10^{-10}$-$10^{-7}$ mbar, emission currents between 1 and 10 μA, RF pk-pk amplitudes between 20-50 mV, filament bias between 70 and 120V and ramp repetition rates ~15-50 Hz.

Figure 5:
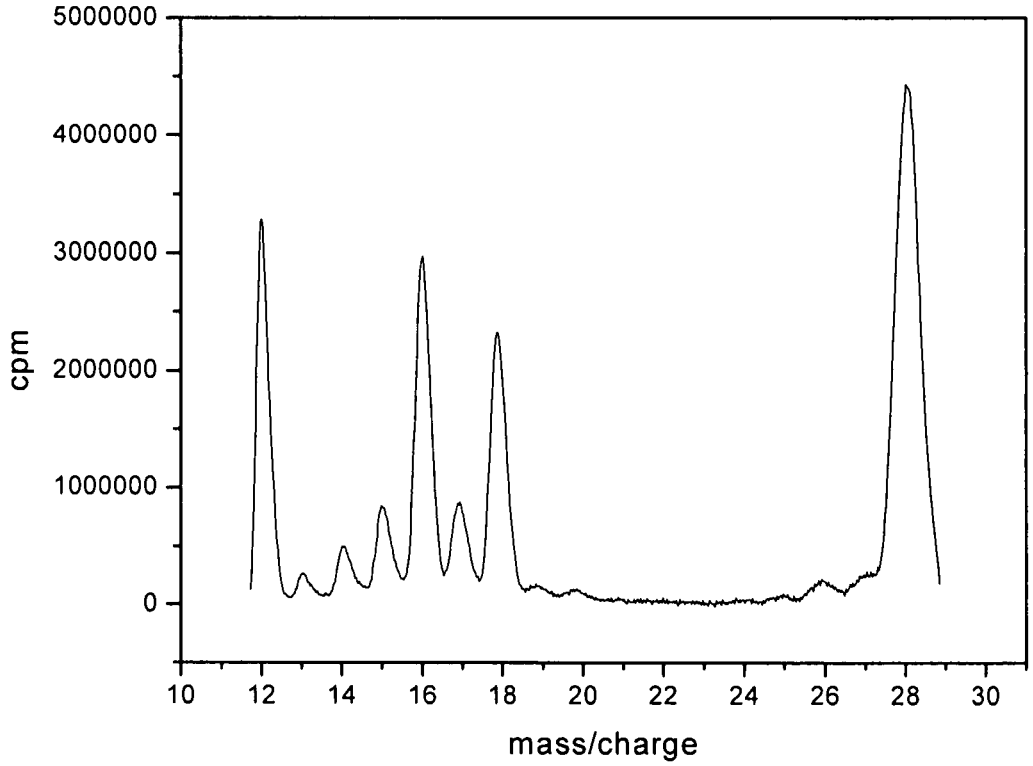
FIG. 5 is a drawing of a mass spectrum of residual gases at $1\times10^{-7}$ Torr. Fixed RF frequency of 0.88 MHz, 200 $mV_{p\text{-}p}$. Trap potential scanned from 200V to 600V in 20 ms.

In a second mode of operation the same basic configuration as shown in FIG. 3, the preferred embodiment, is used but in this case the drive frequency remains fixed while the trapping potential is increased in amplitude. In this second mode of operation the same electrostatic ion trap of FIG. 3 is used to selectively and sequentially eject all positive valued M/q ions, while holding the applied RF at a fixed frequency. The ions are then ejected by ramping the middle electrode voltage to increasingly more negative biases (for positive ions). As the absolute value of the bias is increased (made more negative) the energy of all ions will be instantaneously lowered. (The initial effect is to make the positive ions become more tightly bound and at a given amplitude of motion increase the natural oscillation frequency.) But, assuming some ions are initially nearly resonant with the driving frequency, the RF field will compensate by pumping up the energy of those ions so that the natural oscillation frequency remains essentially resonant with the fixed RF frequency. In order to achieve this, the ions will be pumped to compensating higher energies, and to larger oscillation amplitudes. As the electrostatic potential is anharmonic (and softens at higher amplitudes), the natural frequencies are thus lowered again to become coincident with the driving RF field frequency. For any given M/q ratio, the critical resonant frequency will approach the fixed driving frequency. When the two frequencies become equal those M/q ions are observed in the mass spectrum. $H^+$ ions are the first to be ejected. Larger M/q value ions are ejected at larger absolute value (more negative) middle electrode potentials. Repeated cycling of the middle electrode bias typically is used to improve signal to noise ratios. The controls required to ramp the DC bias are all included in a generic controller represented by 100 in FIG. 3 an in all other embodiments. The requirements for such a controller will be apparent to those skilled in the art. An example mass spectrum, taken in this manner, is illustrated in FIG. 5.

Mass selective ion ejection is what makes this novel technology such a powerful analytical tool. Even though ion storage within a small and well defined volume is already extremely useful in its own right for physics and physical-chemistry investigations, it is the ability to perform mass selective ion ejection, storage and excitation which makes this technology such a powerful analytical and experimentation tool. Other potential applications of mass selective ion excitation and ejection will be apparent to those skilled in the art.

In both modes of operation, ions are ejected from the anharmonic trap, through transparent or semitransparent ports 5 in metal electrodes 2. The latter could comprise simply a solid electrode 2 with one central aperture. The diameter of one aperture is obviously related to the maximum ion flux that can be transmitted to the ion detector. Detected signal levels will reduce as the diameter is reduced. Ions that are not ejected towards the detector will eventually be collected on the electrode, collected on the central electrode, or may even be scattered out of the confines of the trap. The largest signal levels are associated with a large aperture, of 100% transparency. The problem of this arrangement is the possible penetration of ion extraction potentials fields, from outside, to inside of the trap volume. Such fields do not help in confinement of ion trajectories around the central axis. A high electrode transparency can be maintained, while largely maintaining ion beam confinement, by utilizing a semitransparent mesh in part of the electrode, i.e. semitransparent port 5. Individual "apertures" are much smaller and the stray external fields cannot penetrate so deeply into the trap region. However, for a typical wire mesh, the internal surface is somewhat rough, and this geometric effect on the internal trap potential fields can still scatter ions to wide angles away from the central trap axis. The mesh of port 5 can be improved upon by using flat perforated sheet. (The transparency should optimally remain moderately high.) The perturbations of the potentials in the trap, from x,y independent fields, are then minimized if the potential energy saddle points (between trap and outside) are located just below the internal surface plane, i.e. within the apertures themselves. Yet, if the extraction field outside the trap is too small the saddle points are deep within the apertures and are extremely close to the bias of the electrode itself. For ejection from the trap, the ion trajectory must run over the saddle point without impacting the electrode. If the ejection probability is too low, the ions undergo more cycles within the trap until a saddle point is approached, or until the ions attain enough energy to be collected at electrodes. Too low ejection probabilities, and many repeated cycles, thus reduce the final signal levels. The ejection probability per cycle is maximized by increasing the fractional open area (transparency,) reducing the aperture size, optimizing the aperture shape, and optimizing the strength of the extraction fields.

Autoresonance theory provides not only an excellent theoretical framework to explain the basic operational principles of anharmonic electrostatic traps but also the foundation for instrument design and functional optimization. The principles of autoresonance are used routinely to tweak and optimize the performance of anharmonic electrostatic trap systems and to predict the effects that variations in geometrical and operational parameters might have on performance. The direct relationship between sweep rates and ejection thresholds derived from autoresonance theory has been observed experimentally in our lab and is used routinely to adjust chirp amplitude levels as a function of chirp rate. Energy excitation does not need to be uniquely limited to RF sweeps to pump energy into the trap. It might be possible to axially excite ions using sweeps of magnetic, optical or even mechanical oscillating drives. Though most of the experiments performed in our early prototypes relied exclusively on RF drives at the fundamental frequency, we have experimentally verified that it is also possible to drive an anharmonic electrostatic trap at multiples and submultiples of the natural oscillation frequencies (fundamental). Operation at drive frequencies other than the fundamental might be required to optimize resolution and thresholds or to change ion trap dynamics. A clear understanding of the effect of sub and superharmonics on ion ejection will always be critical to the design of clean RF sweep drive electronics. Both direct and parametric excitation schemes are considered to be under the scope of this invention and possible sources for axial excitation of ion motion. The deleterious effect of subharmonics on fundamental frequency scans can be eliminated if the driving RF field is as uniform as possible throughout the trap (no parametric driving) and RF amplitude kept just above the threshold (any remaining subharmonic amplitude will be below the threshold and will not produce any peaks. There are no superharmonics if the driving RF is a pure sine wave.

AC drives that produce waveforms with shapes other than perfectly sinusoidal might be required to operate an anharmonic electrostatic trap. As an example but not limited to, alternative functional forms such as triangular or square waveforms could be incorporated into the design as needed to optimize operational specifications.

Sweeping frequency of the RF drive can be dynamically controlled during a sweep in a mass-dependent fashion or in time-dependent fashion—i.e. sequential mass ejection is not limited to linear frequency sweeps or chirps. For example, it might be desirable to slow down the frequency sweep rate as you scan down in frequency to optimize the residence times of higher masses within the trap, to reduce the residence time and number of oscillations for light ions and to obtain a more uniform resolution throughout a mass scan. Changes in the temporal profile of the frequency sweep are expected to affect mass resolution, signal intensities, dynamic range and signal-to-noise ratios.

It is common practice in our lab to adjust sweep rates to control resolution and sensitivity. The rules controlling the optimization of mass spec parameters are also governed by the general principles of autoresonance. One standard adjustment performed to increase resolution is to decrease frequency sweep-rates while utilizing the smallest possible RF amplitude to achieve autoresonance. Under the previous conditions, the ions spend the longest possible time undergoing oscillations along the axis where the highest resolution is achieved. Minimizing RF amplitudes also assures absence of contributions to the spectra output from subharmonics.

The efficiency of ion trapping and ejection in ART MS systems will be very dependent on several design and operational factors. No specific claims are made in terms of ionization, trapping, ejection and detection efficiencies. A substantial number of ions, i.e. as needed to carry out experiments and/or measurements, will need to be produced and stored within the confines of the trap and a certain fraction of those ions will be ejected along the axis. In addition to axial ejection it is expected that ions will also be radially ejected during the operation of ART MS and the use of such ions for experimentation, measurement, transport or storage (both upstream and/or downstream from the trap) is also considered to be under the scope of this invention.

It is important to realize that even though most of the electrostatic trap embodiments described in this section rely on cylindrically symmetric designs, and use exclusively axial nonlinear oscillatory motion to excite and eject ions, each confined ion in a three dimensional ion trap will generally have more than one natural oscillation frequency. For example, with proper design, it is possible to employ oscillatory motions in a cylindrically symmetric trap in both axial and radial dimensions. As long as those oscillatory motions are nonlinear, it will be possible to use autoresonant excitation to excite their natural frequencies. The excitation of nonlinear motions other than axial, and based on the principles of autoresonance, is also considered to be under the scope of this invention and its benefits and opportunities derived will be apparent to those skilled in the art. For example, excitation of radial modes in a cylindrical trap could be used to eject ions in directions orthogonal to the cylindrical axis. Excitation of radial modes could also be used to clean a trap of undesired ions prior to axial ejection, or it could also be used to excite or cool ions in order to provide enhancement or reduction of fragmentation, dissociation of reaction processes prior to ion sourcing or mass spectral analysis. The general mass selective ion-energy excitation principles described in this application are not limited to traps of cylindrical symmetry. All directions of motion with associated nonlinear natural frequencies in a three-dimensional electrostatic trap are susceptible to autoresonant excitation and are considered under the scope of this invention.

Even though only frequency modulation was discussed in the above sections, amplitude modulation, amplitude sweeps or amplitude stepping might be beneficial to trap operation. Temporal amplitude modulation could be used to enhance detection capabilities of the mass spectrometer by providing the ability to produce phase-sensitive detection. Amplitude modulation could also be used to modulate the amplitude of ion signals and to provide synchronization with downstream mass filter/storage devices in tandem setups. Amplitude sweeps or steps could be used to provide mass specific sensitivity enhancements in mass spectra. For example to achieve maximum ion detection/signal dynamic range, where the ions are now phase locked to the driving AC/RF voltage, $V_{AC/RF}$, frequency, $f_D$, it is very convenient to synchronously demodulate the detector output with an optimal signal derived from $V_{AC/RF}$ and/or the frequency of the amplitude modulation, $f_{AM}$, to obtain maximum detector S/N.

Even though only external drives have been considered up to this point, there may be reasons to modulate and/or sweep and/or step the amplitude of the trapping voltage used to establish an electrostatic potential well. The amplitude of the trapping potential could be stepped in order to provide synchronization with ion injection or ejection. The amplitude of the trapping potential could also be stepped in order to provide different trapping conditions leading to ion energy cooling conditions or (the opposite) collision induced dissociation and fragmentation. Modulation of the trapping potential could be used to pump energy into the oscillating system, as a primary or secondary ion energy excitation system.

It may be desirable to alternate between fixed frequency excitation and swept frequency excitation in order to manipulate the amplitude of the oscillations and the energy of the ions confined within the trap. A plurality of sweeps, with multiple frequencies, may be applied simultaneously for multi-mass axial excitation to rapidly clean out a trap and/or to selectively eject specific ions and/or trap pre-selected ions. It might also be desirable to mix fundamental (harmonic) with super and subharmonics in the drive to achieve very specific trapping, ejection or timing conditions.

Since axial excitation is possible at the fundamental as well as sub and superharmonics, it is going to be important to understand and control the spectral purity of the RF sources used to pump energy into the axial oscillations of ions. For example, most commercially available RF sources will exhibit harmonic distortion, which will theoretically increase noise in the mass spectra and reduce SNR. Harmonic distortion might also create mass spectral analysis complexity through overlaps of sub and superharmonic driven spectra into the total mass spectrum. Also note that DC sources used to create the electrostatic sources also contain AC impurities that may corrupt ion injection, excitation, ejection, and/or detection, therefore, it is implicitly understood that design methods to limit its contribution to noise will be very important to optimal operation. As a further note, the AC signal/noise that is typically seen on a DC Voltage source could be optimally controlled to construct a AC/RF autoresonant sweeping source, VAC/RF, thereby utilizing it for a design advantage.

A very unique advantage of this ejection technology is the fact that no active feedback is required to effect energy pumping and ion ejection. Because of that, a single RF drive could be used to simultaneously pump a multiplicity of traps without any trap specific feedback or dedicated tuning parameters being necessary. The low power requirements for the small signal RF drive, and the lack of a feedback requirement for non-linear excitation is what makes mass selective ejection based on autoresonance a completely novel concept.

Another important concept related to autoresonant excitation in anharmonic traps is the fact that since ion motion in the axial dimension is not coupled to motion in the radial direction, the autoresonant pumping mechanism described above can be applied for axial ejection even if other means of radial confinement are present. Alternative trap designs can be employed in which strong electrostatic anharmonicity and autoresonance could be used to axially confine and eject ions while radial confinement is produced by other means such as multipole, ion guide or magnetic field confinement.

The AC drive could be connected to the anharmonic trap in many different ways for the purposes of generating axial energy excitation through autoresonance. RF signal can be coupled to all or some of the electrodes. In order to minimize the contribution of subharmonic excitations it is desirable to establish uniform RF fields across the length of the trap, with the rf field amplitude varying smoothly and symmetrically along the central axis of the trap. The details of the implementation of RF sweep excitation in an anharmonic electrostatic ion trap will depend on the specifics and requirements of the design and often on the particular preferences of the instrument designer. The different options available in this respect will be apparent to those skilled in the art.

The application of a supplemental RF excitation to the electrostatic linear ion trap means that a pseudopotential is developed inside the trap. Although only an abstraction, it may be considered that this pseudopotential adds to the real electrostatic potential and may impact the frequency of oscillation of the ions in the axial direction. This effect must be carefully considered and understood during the design and operation of the trap and may also be exploited as needed to optimize or modify the performance of the spectrometer.

Ion Generation

FIG. 3 represents a typical embodiment of a mass spectrometer system based on an anharmonic resonant trap and with an electron impact ionization (EII) source. Electrons are (1) generated outside the trap 18, (2) accelerated towards the trap by a positive potential (i.e. attractive force), (3) access the trap through a semi-transparent wall 4, (4) decelerate and turn around in the trap, and (5) typically leave again through the same entrance 4. During their short path in-and-out of the trap, the electrons collide with gas molecules and produce (1) positive ions through electron impact ionization and (2) negative ions through electron capture (a less efficient process). The ions formed inside the trap with the proper polarity immediately commence their oscillations back and forth along the axial anharmonic potential well.

Figure 6:
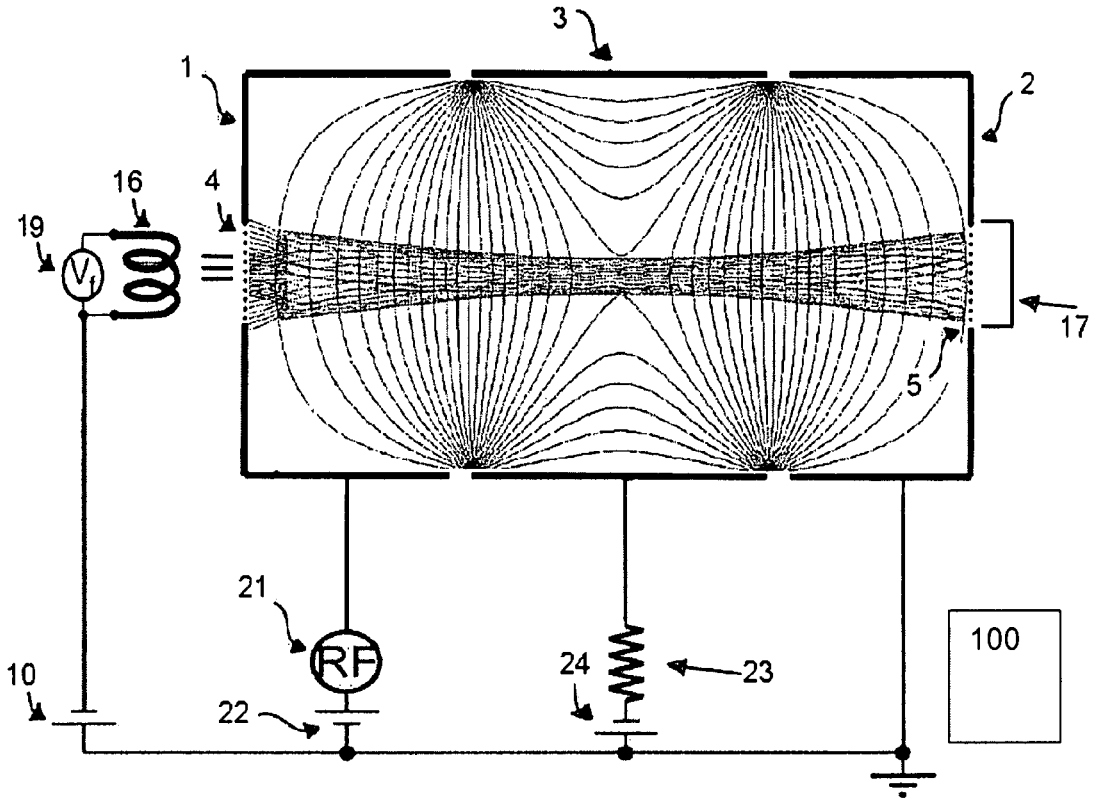
FIG. 6 is a computer generated representation of electron and ion trajectories in a second embodiment of the anharmonic electrostatic ion trap.

Typical electron and ion trajectories are illustrated in FIG. 6 corresponding to a second embodiment for the anharmonic electrostatic ion trap configured again as a mass spectrometer. The radial and axial confinement of the ions is illustrated by the parallel lines corresponding to ions formed inside the trap (i.e. −120V equipotential).

Assuming a cathode 16 potential of −120V, the electrons enter the trap and turn around at the −120V equipotential of the trapping potential. The electron kinetic energies therefore range, between ~120 (entry point) and 0 eV (turn around point). A small fraction of the electrons are then able to ionize gas species anywhere within the ionization region, to create ions of a range of total energies, some of which are trapped within the electrostatic trap. No specific claims are made as to the efficiencies of these processes, but it will be understood by those skilled in the art that various changes in form and detail maybe made to this ionization scheme without departing from the scope of the invention.

Figure 7:
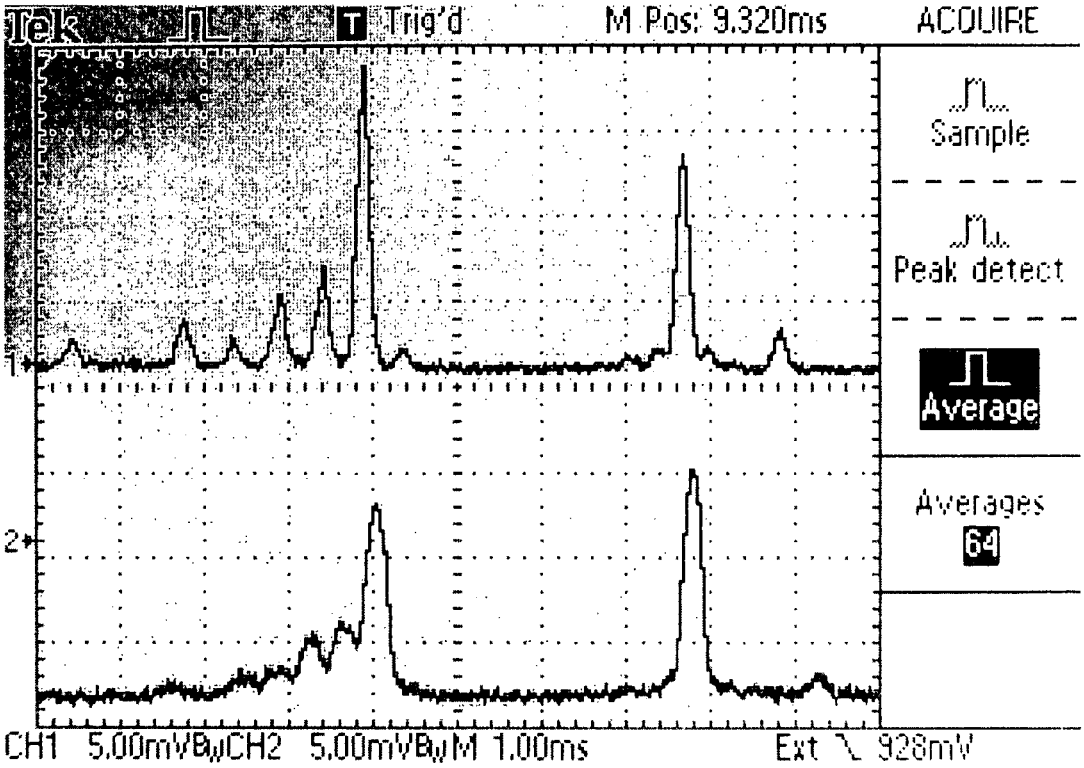
FIG. 7 is drawing of a comparison of mass spectra from background gases at $2\cdot10^{-8}$ Torr. The top spectrum is taken with the electrostatic ion trap mass spectrometer of FIG. 6 and the lower with a commercial quadrupole mass spectrometer (UTI).

FIG. 7 is a typical spectrum of residual gases obtained from an electrostatic ion trap mass spectrometer with a design based on the second embodiment of FIG. 6. The overall diameter of the cylindrical assembly was 12.7 mm. Cup 1 was 7.6 mm deep, center tube 3 was 8 mm long and cup 2 was 7.6 mm long. Apertures 4 and 5 were 1.6 mm diameter. Resistor R was 100 kOhm. The ion trap potential 24 was −500V, the applied RF amplitude was 70 $mV_{p-p}$, a 2V DC offset 22 was used in order to prevent ions from leaving the trap from the ionizer side, a 1 mA electron current employed, and with 100 eV maximum electron energy. The bottom spectrum serves as a comparison against a standard commercially available quadrupole mass spectrometer, UTI 100C available from MKS Industries.

Even though a simple configuration such as the one described in FIG. 6 is a very straightforward way to produce ionization within an ion trap, it is certainly not the only way to produce and trap ions in an ion trap. Ions can be confined within the trap after generation of ions through a wide variety of means. Most of the modern ionization schemes used to produce ions in all available mass spectrometry techniques will be totally or at least somewhat compatible with this new ion trap technology. In order to better organize, list and discuss the known ionization methodologies presently available to mass spectrometry practitioners, ionization techniques will be divided into two major categories: (1) internal ionization (i.e. ions are formed inside the trap) and (2) external ionization (ions are created outside and brought into the trap by different means.) The lists presented below are to be considered as reference-only material and will not attempt to be an all inclusive summary of ionization schemes available to mass spectrometry applications based on the anharmonic electrostatic ion trap of this invention.

It should be apparent to those skilled in the art that the analytical versatility of this new mass spectrometry technique relies on its ability to perform mass spectrometry on both internally and externally generated ions. Most of the ion injection methods developed for quadrupole based mass spectrometers and time of flight systems can be adapted to the new technology and the particular implementations will be apparent to those skilled in the art.

Internal Ionization

Internal ionization refers to ionization schemes in which the ions are formed directly inside the anharmonic electrostatic ion trap. The electrostatic potentials applied to the electrostatic linear ion trap during ionization do not need to be the same as those present during excitation and mass ejection. It is possible to employ trapping conditions specifically programmed for the benefit of the ionization processes, followed by subsequent changes in bias voltages to optimize ion separation and ejection.

Electron Impact Ionization (EII)

As illustrated in FIGS. 3 and 6, energetic electrons are brought into the trap from outside and used to ionize atoms and molecules contained inside the trap. There are multiple ways to introduce electrons into a trap including both radial and axial injection schemes. In a closed trap (i.e. with a low gas conductance path to the outside), the filament can be immersed in the process gas (higher pressure) while the electrons are brought into the low pressure environment of the trap through low conductance apertures. There is also a large variety of electron emitters which can also be considered to source electrons. Some common examples of electron sources are mentioned next, though the list is by no means all inclusive: Hot cathode thermionic emitters (16 in FIGS. 3 and 6), field emitter arrays (Spindt design, SRI), electron generator arrays (Burle Industries) as described in Bruce Laprade, U.S. Pat. No. 6,239,549, electron dispenser electrodes, Penning traps, glow discharge sources, button emitters, carbon nanotubes, etc. Cold electron emitters based on new materials are continuously being discovered and commercialized and it is fully expected that all mass spectrometers including those in this invention will be able to benefit in the future from those discoveries. Cold electron emitters based on field emission processes offer some peculiar advantages such as fast turn on times which might be beneficial for the fast pulsed operation modes described below. Cold electron emitters are also preferred for applications where highly thermally labile analytes should not come in contact with incandescent filaments during analysis. For typical electron energies above 15 eV, electron impact ionization generates mostly positive ions with high efficiency and a relatively small amount of negative ions. Notice that some of the cold emitters could be directly mounted or built on to the entrance plate/electrode 1 in which case the electrons would not need to be exposed to the environment outside the trap and a very compact design could be achieved.

Figure 8:
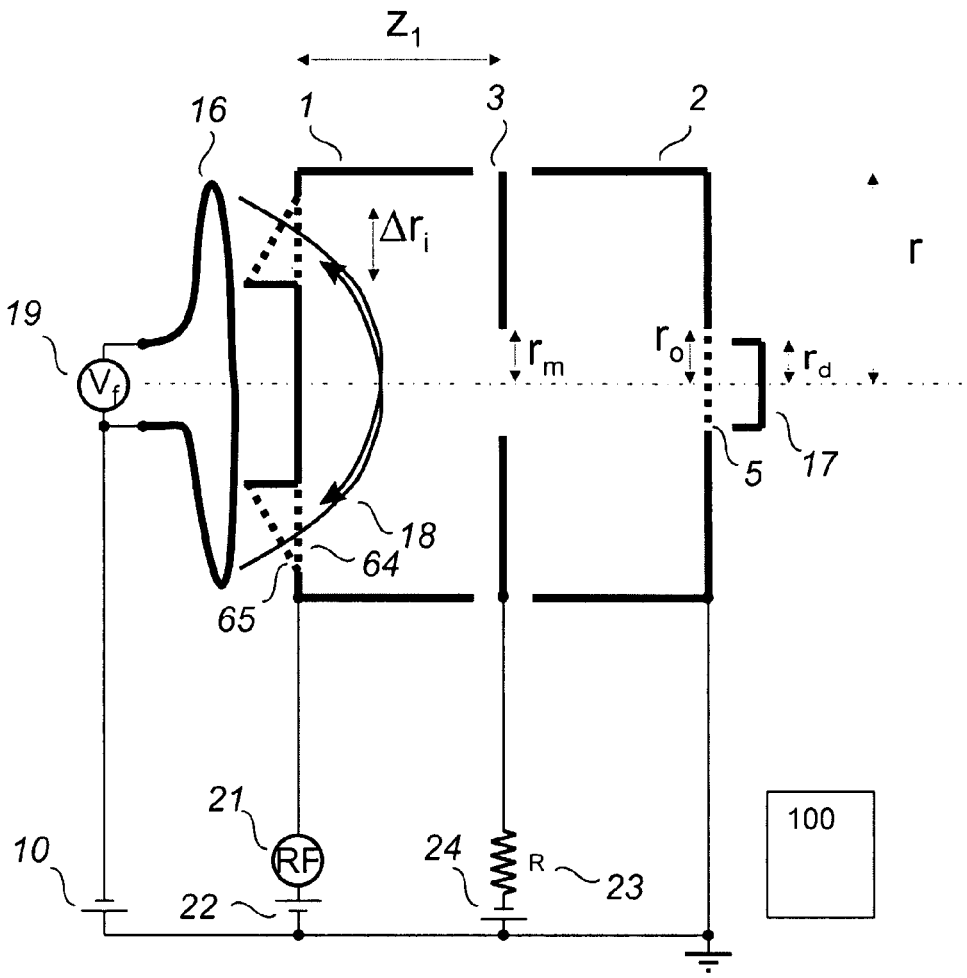
FIG. 8 is a schematic diagram of an electrostatic ion trap with an off-axis electron gun and a single detector.

In a further embodiment, FIG. 8, also derived from our preferred embodiment of FIG. 3, electrode 1 and the filament 16 have a design that allows electron trajectories 18 that run only in confined regions within the electrostatic ion trap. In this manner ionized gas species that are to be confined in the trap cannot be formed very close to electrode 1. This limits the total energy of the newly formed ions to energies which are significantly below that required for immediate ejection from the trap. All ions therefore require subsequent RF pumping before ejection and detection. FIG. 8 illustrates a filament 16 that runs around the cylindrical axis. Electrons are drawn in the direction of the axially symmetric electrode 1. A fraction of emitted electrons are injected into the trap through two axially symmetric conductive meshes, 64 and 65, mounted at radii with a spread $\Delta r_i$. The advantages of an off-axis electron gun configuration such as shown in FIG. 8 will be apparent to those skilled in the art and the particular implementation of FIG. 8 is just one of many possible ways available to achieve the stated effects.

Figure 9A:
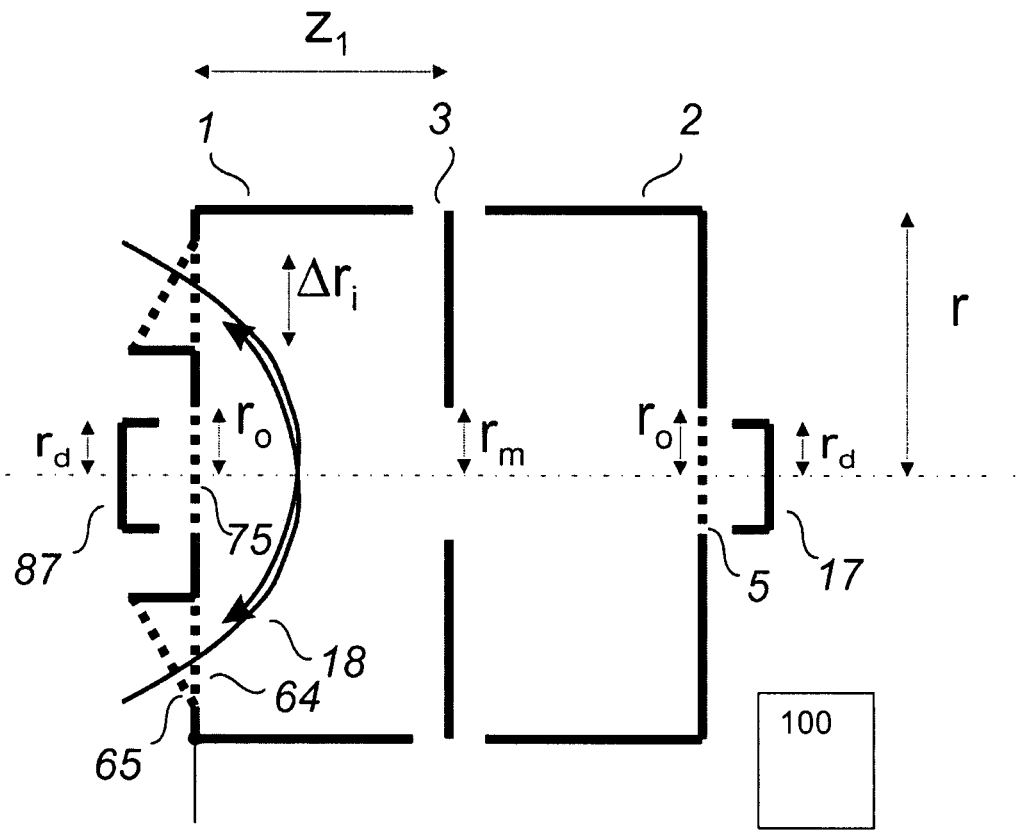
FIG. 9A is a schematic diagram of an electrostatic ion trap with an off-axis electron gun with symmetric trapping field and dual detectors.

In yet a further embodiment (FIG. 9A, also derived from our preferred embodiment (FIG. 3) electrode 1 can have an axial aperture, 75, of radius ro that is filled with a semitransparent conducting mesh. Akin to the mesh within aperture 5 in electrode 2, the mesh within aperture 75 in electrode 1, allows transmission of ions into an ion detector 87. In this embodiment the potentials within the trap should be symmetric about the middle electrode 3. An offset supply 22 is not used and the DC bias of electrode 1 is at ground, just as is the bias of electrode 2. For the symmetric trap the onset of ion ejection through aperture 75, for each particular M/q ion, occurs simultaneously with the onset through aperture 5. The ion currents in ion detectors 17 and 87 should be summed before generating a mass spectrum.

Electron Capture Ionization (ECI)

Low energy electrons are directed into the trap and captured by electronegative molecules producing negative ions. ART MS is not limited to positive ion detection only. In fact, switching from positive to negative ion operation in a simple trap such as in FIG. 6 can be achieved through a single polarity reversal in the trap potential 24.

Chemical Ionization (CI)

Ions are introduced into the trap which then produce new ions through chemical interactions and charge exchange processes with the gas molecules (analyte) present inside the trap.

Radioactive Sources (Ni-63, Tritium, etc.)

A radioactive source located inside the trap emits energetic β-particles which produce ionization of gas molecules inside the trap. Ni-63 is a common, though not the only, material used for this purpose in mass spectrometers. A significant advantage of Ni-63 emitters over other radioactive emitters is their compatibility with plating processes for direct deposition on the metallic plates of the trap.

Laser Desorption Ionization (LDI)

The sample (usually, but not exclusively, a solid) is placed inside the trap and ions are desorbed by laser ablation pulses directed into the trap volume. The sample can be suspended on any kind of substrate such as the internal surface of one of the electrodes or removable sample microwells made out of metal or resistive glass.

Matrix Assisted Laser Desorption Ionization (MALDI)

A biological sample embedded in a proper organic matrix (usually an acid) is placed inside the trap and laser pulses with the proper optical wavelength and power are used to ablate biomolecules into the trap and ionize them through proton transfer reactions from the matrix molecules. MALDI is ideally suited for traps and provides the simplest way to use anharmonic ion traps for biomolecular analysis. MALDI traps could be used to store, select and push ions into the ionization regions of orthogonal injection MALDI TOF systems.

Optical Ionization (VUV, EUV, Multiphoton Vis/IR)

Energetic photons from lasers or lamps cross the internal trap volume (axially and/or radially) and produce ionization through single or multiphoton ionization events. UV, visible, Deep UV, Extreme UV and even high brilliance IR sources are routinely applied for molecular ionization purposes. Single photon, multiphoton and resonantly enhanced multiphoton Ionization are some of the optical ionization schemes compatible with Mass Spec applications. Crossed optical beams can be used not only for ionization but also for photochemical interaction and fragmentation with selectively trapped ions.

Desorption Ionization on Silicon (DIOS)

A variation of the MALDI approach where ions are placed on a silicon substrate and no organic matrix is required. Better suited for non-biological samples than MALDI, provides a simple way to extend the reach of anharmonic electrostatic ion trap mass spectrometers into the analysis of some of the smaller analyte molecules of interest for biological analysis.

Pyroelectric Ion Sources

Pyroelectric ion sources, as described, for example, in Evan L. Neidholdt and J. L. Beauchamp, Compact Ambient Pressure Pyroelectric Ion Source for Mass Spectrometry, Anal. Chem., 79 (10), 3945-3948, have recently been described in the technical literature and provide an excellent opportunity to produce ions directly inside an ion trap with minimal hardware requirements. The simplicity of pyroelectric sources is clearly an excellent complement to the simplicity of mass spectrometry instrumentation based on anharmonic electrostatic ion traps. Low power portable mass spectrometers could be constructed relying on pyroelectric ionization sources and anharmonic electrostatic ion traps.

Fast Atom Bombardment (FAB)

This ionization methodology has been almost completely displaced by MALDI but it is still compatible with ART MS and could be used with the novel traps if needed.

Electron Multiplier Sources

Electron multipliers can be modified/optimized to spontaneously emit electron beams while electrically biased. See for example, Burle Industry's Electron Generator Arrays (EGA) based on Microchannel Plate technology, as described in U.S. Pat. No. 6,239,549. EGAs optimized to spontaneously emit electrons, simultaneously emit ions from the opposite face (a well known fact). The ions are the product of electron impact ionization processes between the trapped gases and the electron amplification avalanches taking place inside the microchannels. The ions emitted from the EGA can be fed into the trap and used for mass selective ejection and mass spectral detection. Electron multiplier ion sources have been suggested in the past and will be compatible with anharmonic electrostatic ion traps. In fact it is possible to employ a mass spectrometer design in which the entry electrode 1 is the ion emitting face of an EGA adequately biased to emit positive ions directly into the trap.

Metastable Neutrals

Metastable neutral fluxes could also be directed into the trap to produce in-situ ion generation.

External Ionization

External ionization refers to ionization schemes in which the ions are formed outside the anharmonic electrostatic ion trap and brought into the trap through different mechanisms well understood by those skilled in the art of mass spectrometry.

External ion injection can be implemented in both radial and axial directions. For axial injection, ions may be produced externally and then injected into the trap by a fast switching of at least one end electrode potential. The end potential must then be restored rapidly to prevent significant reemergence of the intended injected ions. The capability to trap externally generated ions is a very important advantage of anharmonic electrostatic ion traps which provides the same level of versatility that is enjoyed routinely with quadrupole ion traps. The electrostatic potentials used by the anharmonic electrostatic ion trap during ion injection can differ from the trapping potentials used for mass analysis or ion storage. The ions can be produced at the same vacuum conditions of the trap or might be brought into a closed trap from higher pressure environments through standard ion manipulation and differential pumping technologies well known to those skilled in the art. Atmospheric ionization schemes are readily compatible with this technology provided proper differential pumping is employed.

Figure 9B:
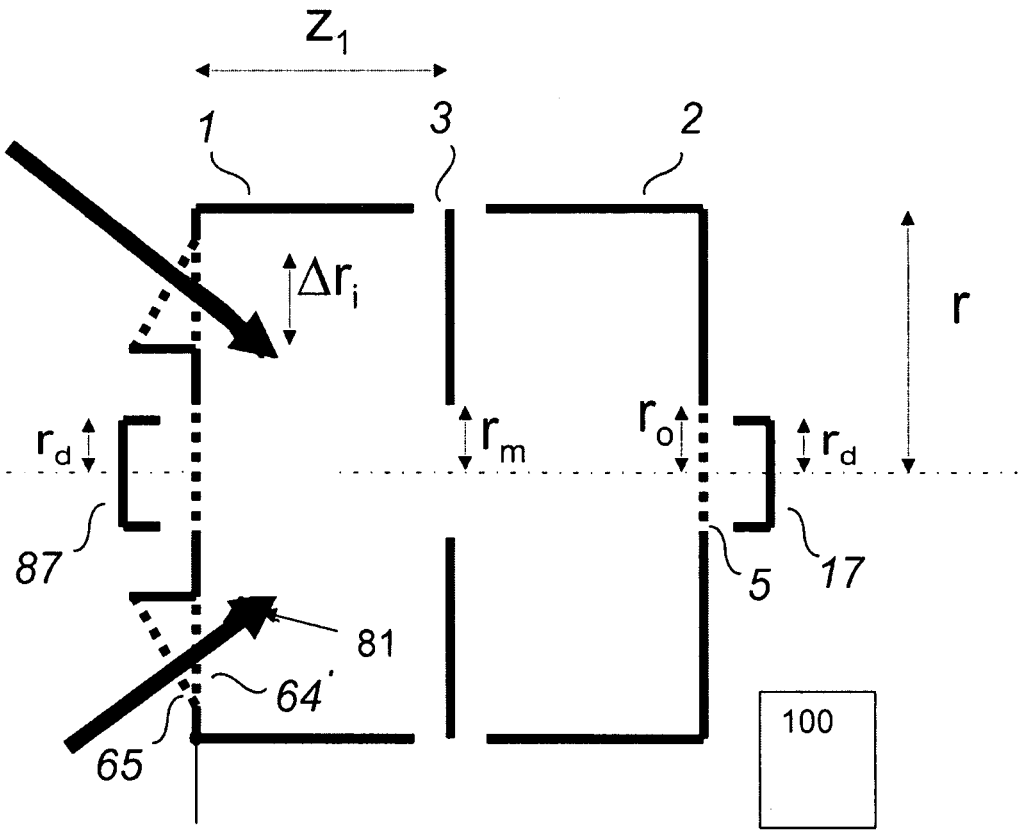
FIG. 9B is a schematic diagram of entry paths for externally created ions into an electrostatic ion trap.
Figure 9C:
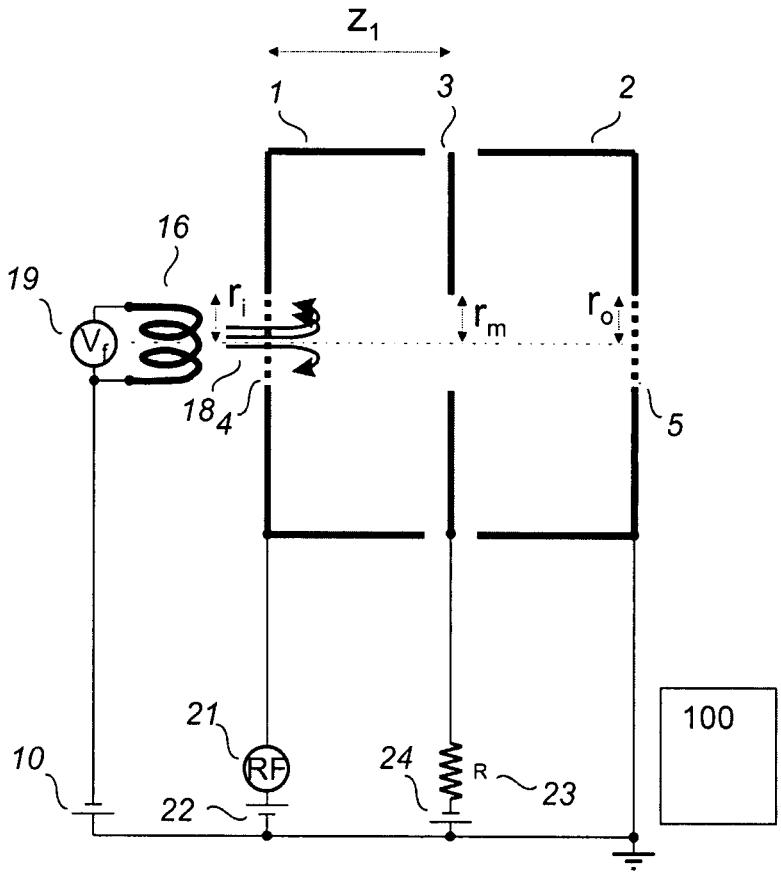
FIG. 9C is a schematic diagram of an electrostatic ion trap, configured as a mass-selective ion beam source, with an electron impact ionization source and no detector.

Following is a list of some of the most common ionization technologies used in modern mass spectrometers and known to be compatible with the external generation of ions for anharmonic electrostatic ion traps. This list is not considered to be exhaustive but rather a representative sample of some of the available methodologies available to modern mass spectroscopists and plasma/ion physicists. The list includes: Electro Spray Ionization (ESI), Atmospheric Pressure Photo Ionization (APPI), Atmospheric Pressure Chemical Ionization (APCI), Atmospheric Pressure MALDI (AP-MALDI), Atmospheric Pressure Ionization (API), Field Desorption Ionization (FD), Inductively Coupled Plasma (ICP), Penning Trap Ion Source, Liquid Secondary Ion Mass Spectrometry (LSIMS), Desorption Electro Spray Ionization (DESI), Thermo-spray Sources, and Direct Analysis Real Time (DART). Whereas the embodiment of FIG. 9A assumes that electron impact ionization is used to generate ions (electron beam 18) it is also possible to construct yet a further embodiment FIG. 9B in which the electron beam 18 of FIG. 9A is replaced by a beam of ions 81 in an external ion introduction methodology. In this case the voltages of 65 can be temporarily lowered to allow ion seeding and then rapidly reversed to avoid ion losses. In this embodiment, the ion trap can be configured as a mass spectrometer for externally created ions. In an alternate embodiment wherein the ion trap is configured with an electron impact ionization source and without an ion detector, shown in FIG. 9C, the ion trap can be configured as an mass-selected ion beam source. The exact details of implementation of such ionization schemes are not discussed in detail here, as they will be apparent to those skilled in the art of mass spectrometry.

Plate-Stack Assemblies

The two embodiments of FIG. 3 and FIG. 6 correspond to some of the early prototype designs. More recent anharmonic trap designs have been based exclusively on plate stacks for the electrode assembly. As expected, and since autoresonance is not dependent on a strict functional form for the anharmonic curves, there is unprecedented freedom in terms of the exact geometrical implementation of an anharmonic electrostatic ion trap.

Figure 10:
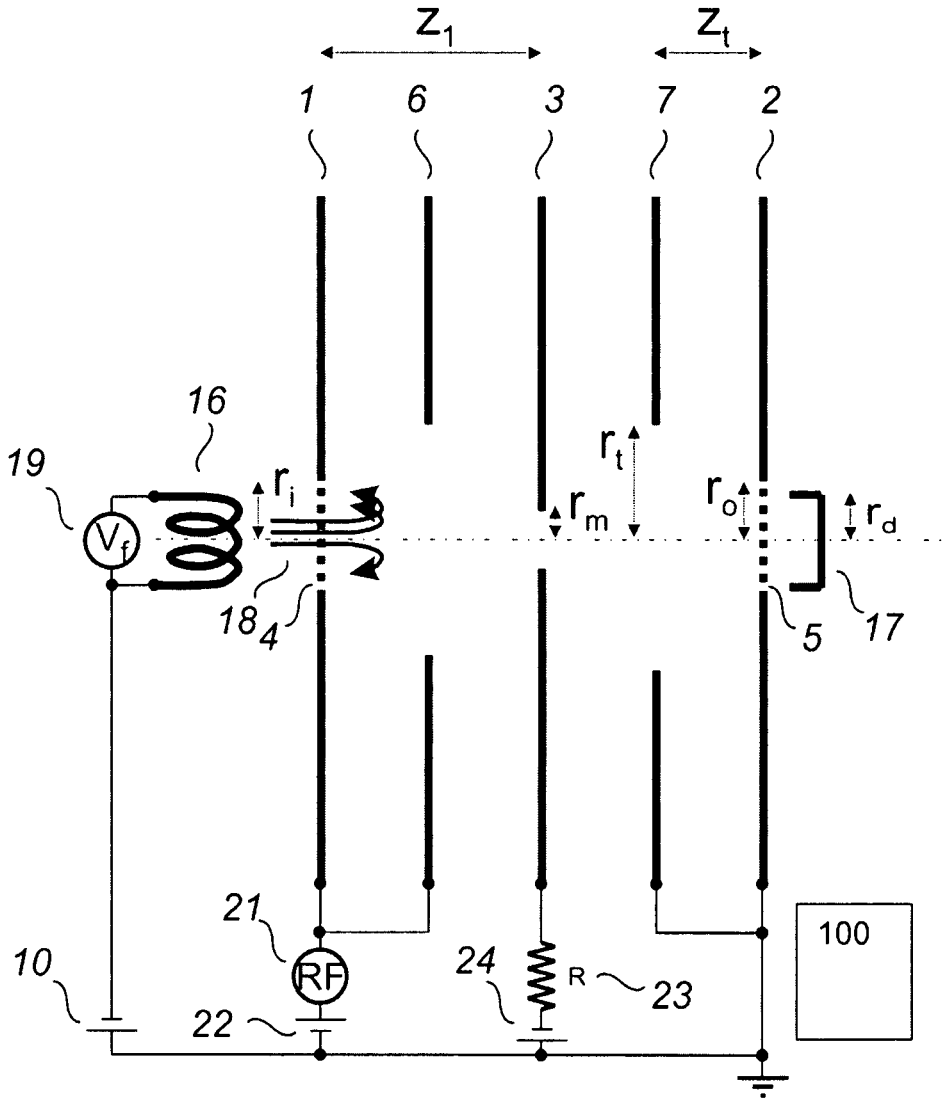
FIG. 10 is a schematic diagram of a third embodiment of an electrostatic ion trap which relies exclusively on plates to define the ion confinement volume, electrostatic fields and anharmonic trapping potential along the ejection axis.

FIG. 10 corresponds to a third embodiment for an anharmonic ion trap which relies exclusively on plates to define the ion confinement volume, electrostatic fields and anharmonic trapping potential along the ejection axis. In this design the ion trap is made of 5 parallel plates. The aperture dimensions are designed to mimic the potential distribution along the focused trap trajectories that are found in cup based designs. As an example compare the equipotentials for this design, and illustrated in FIG. 11, to similar equipotentials in the cup design of FIG. 1.

Figure 12:
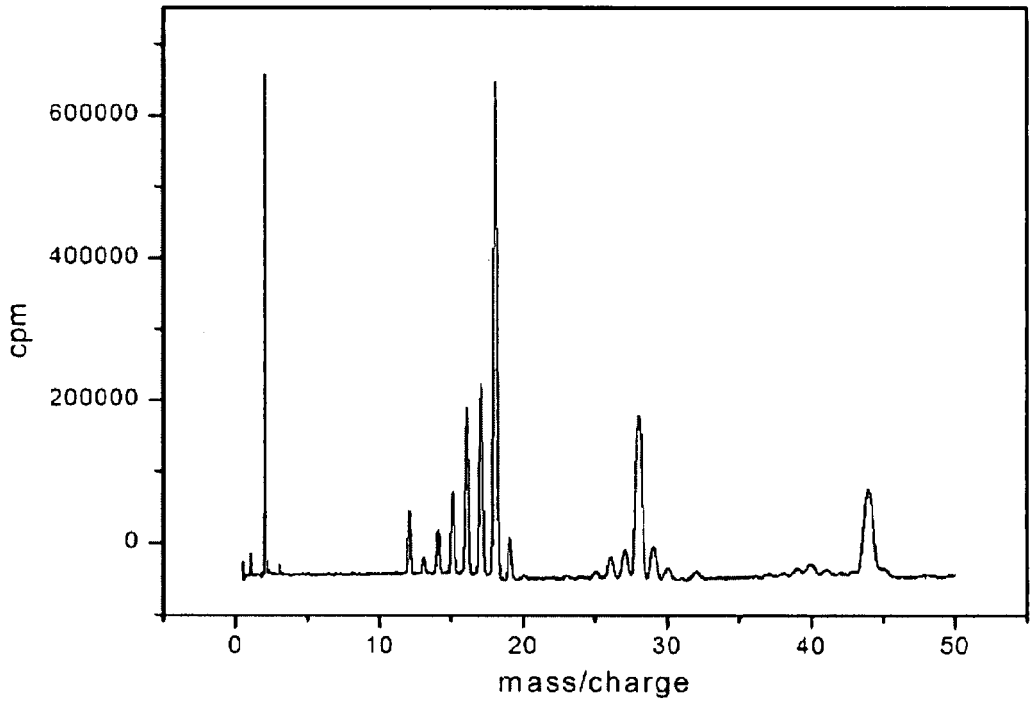
FIG. 12 is a drawing of a mass spectrum obtained from the operation of the third embodiment (FIG. 10). Resolution M/ΔM: 60 for the peak at 28 amu. RF=70 mv P=$7\times10^{-9}$ $I_e$=1 mA $U_e$=100V rep=27 Hz $U_t$=200 V.

In this third embodiment, FIG. 10, the end electrodes 1 and 2 are planar. Planar trap electrodes 6 and 7 are each placed half way between the middle electrode 3 and respectively the end electrodes 1 and 2. (Zt=Z1/2) The apertures within the trap electrodes 6 and 7 each have an internal radius $r_t$. Typical dimensions are: $Z_t$=12 mm, $r_i=r_o=r_d=Z_t/2$, $r_m=Z_t/4$, $r_t=Z_t$. The potentials of the trap electrodes 6 and 7 are respectively those of end electrodes 1 and 2. Typical operational parameters include: 70 $mV_{p-p}$ amplitude for RF drive 21, −2 KV trapping potential 24 along the anharmonic axis of oscillation, 27 Hz RF frequency sweep rate, 100 KOhm decoupling resistor 23, +2V bias voltage 10 on electrodes 1 and 6 to eliminate ion ejection from the ionizer side. FIG. 12 is an example of a mass spectrum collected with the third embodiment of FIG. 10.

Figure 11:
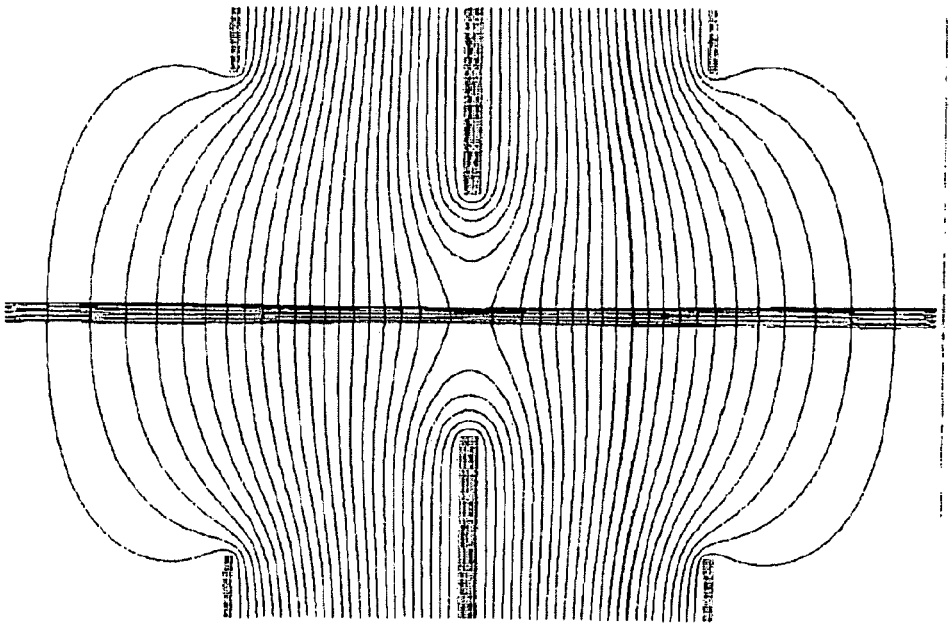
FIG. 11 is a computer generated representation of equipotentials for the third embodiment (FIG. 10) from SIMION modeling.
Figure 13A:
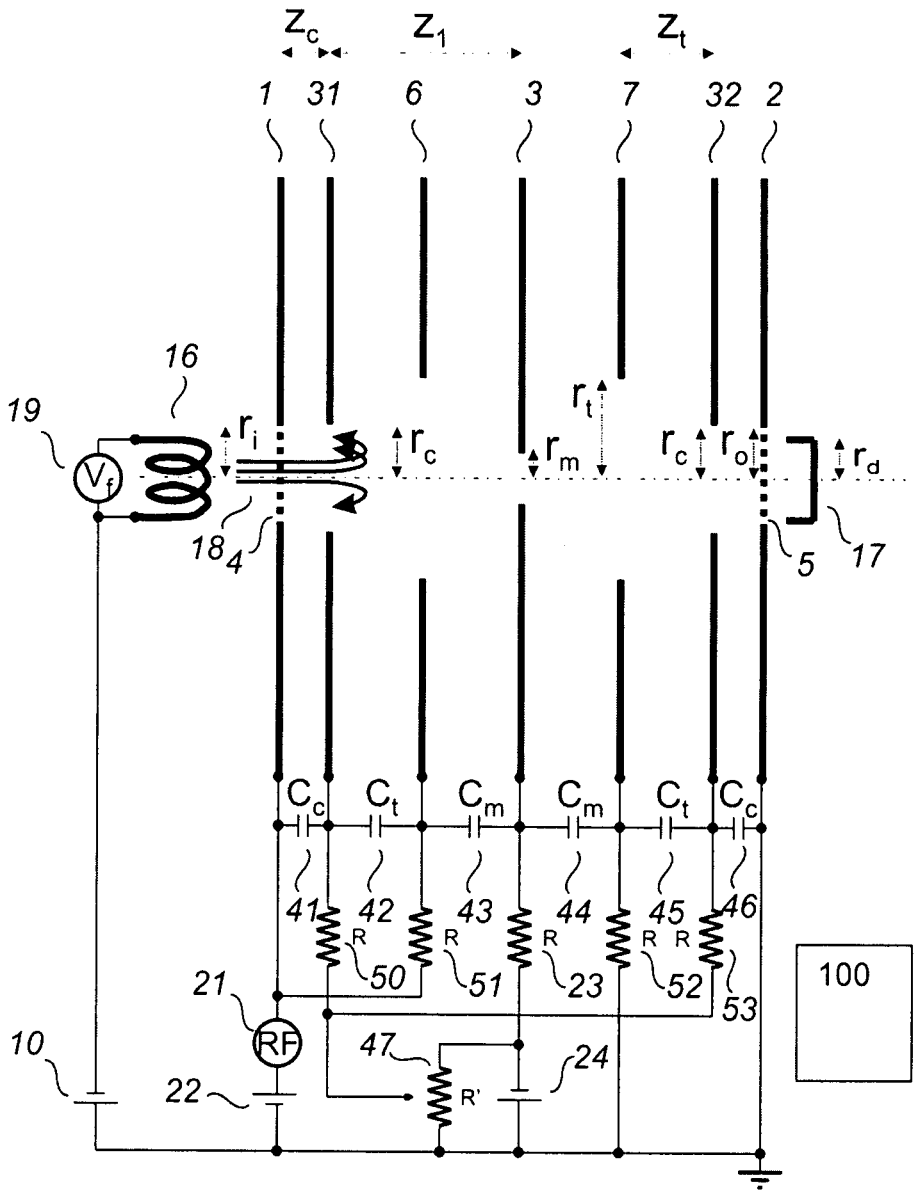
FIG. 13A is a schematic diagram of a fourth embodiment in which two additional planar electrode apertures are introduced to compensate for x and y dependence of circuit periods experienced within the focusing potential fields of FIG. 11.

FIG. 13A represents a fourth embodiment in which two additional planar electrode apertures are introduced to compensate for x and y dependence of circuit periods experienced within the focusing potential fields of FIG. 11. Compensation plates compensate for radial variations in circuit periods of stable ion trajectories, that are initially brought about by the focusing fields of the electrostatic trap. In the absence of compensating fields the potential gradients at the turnaround positions are strongest on the central axis. The turnaround gradients reduce off axis. This radial variation is the major contributor to non uniform circuit periods, for confined ions of any particular M/q ratio. Ion trajectories that are centered on axis have the shortest circuit times. This non uniformity can be largely eliminated by application of optimal compensating fields. Relative dimensions of compensating plates usually are: $Z_c=Z_t/2$, $r_c=Z_t$. Aperture dimensions $r_c$ in the compensating electrodes 31 and 32 are similar in dimension to inlet and outlet aperture dimensions $r_i$ and $r_o$ of end electrodes 1 and 2 respectively. The separation of electron inlet electrode 1 from compensation electrode 31, $Z_c$, equals the separation of ion outlet electrode 2 from compensation electrode 32. The overall length of trap is extended by twice $Z_c$.

Figure 14A:
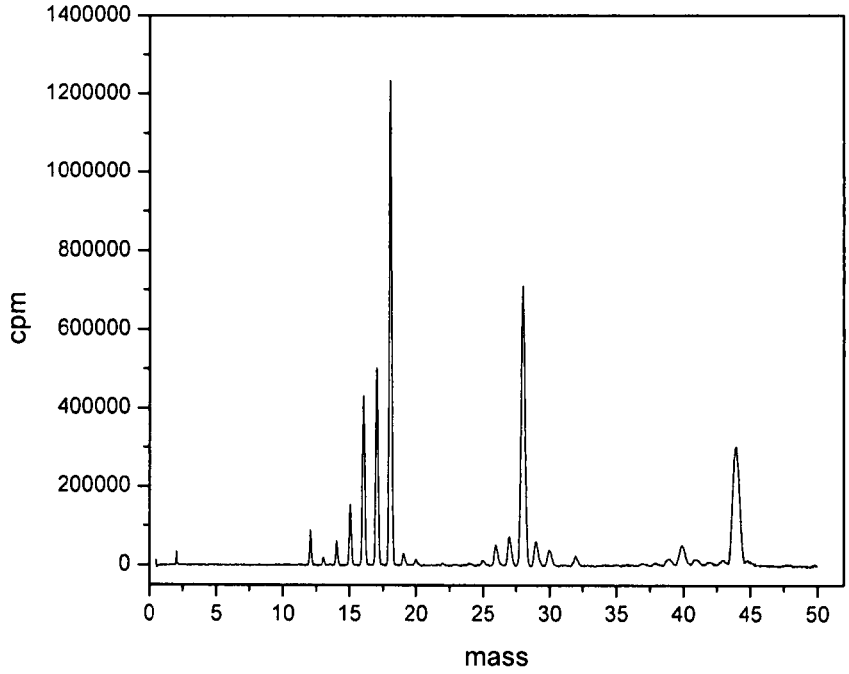
FIG. 14A is a drawing of mass spectrum showing the best resolution scan achieved without compensating plates, at $3.5\times10^{-9}$ Torr pressure with a MS shown in FIG. 10. The RF p-p amplitude (21) was 60 mV, emission current 1 mA, electron energy 100V, scan rep. rate 27 Hz, $U_m$=2000V, DC offset (22) 1V. Gaussian fitting of the peak at mass 44 indicates a peak width of 0.49 amu, which means that the resolution M/ΔM was 90.
Figure 14B:
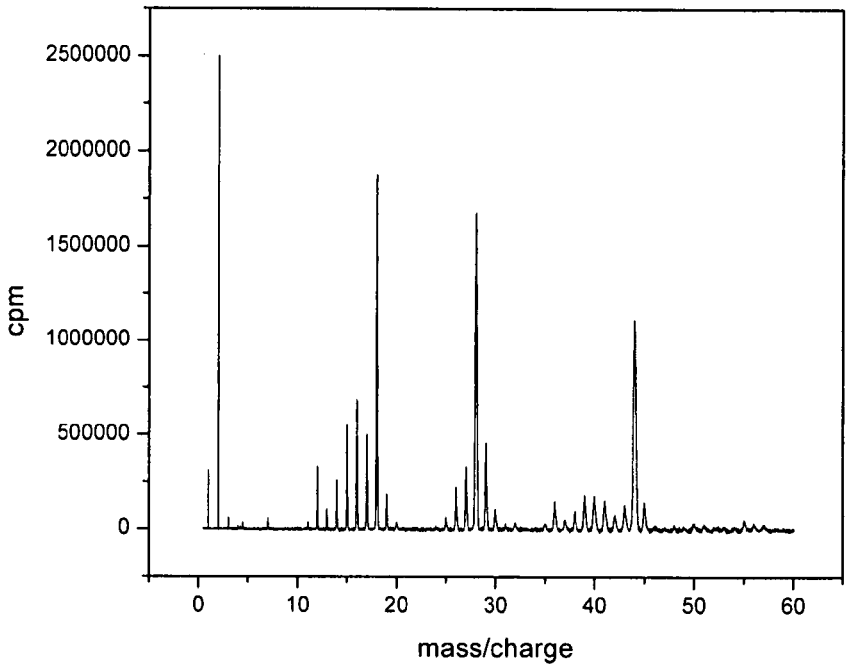
FIG. 14B is a drawing of a mass spectrum showing a high-resolution scan of residual gases at $6\times10^{-9}$ Torr pressure acquired with the MS shown in FIG. 13B. The Vp-p amplitude (21) for the RF drive was 20 mV, emission current 0.2 mA, electron energy 100V, scan rep. Rate 7 Hz, $U_m$=1252V, DC offset (22) 1V. Gaussian fitting of peak at mass 44 indicates peak width 0.24 amu, which means that the resolution M/ΔM was improved to 180.

The DC potential of the compensating electrodes 31 and 32 is a fraction of the middle potential $U_m$, typically $\sim U_m/16$. This compensation potential is tapped from an adjustable potential divider R', 47. In this realization external capacitances, 41, 42, 43, 44, 45, and 46, are adjusted to optimize RF fields along the length of the ion trap that are used to resonantly pump the ion energies. Capacitors 41 and 46 have one value, $C_c$. Capacitors 42 and 45 have value, $C_t$. Capacitors 43 and 44 have value, $C_m$. The RF potentials on the compensation electrodes 31 and 32, and trap electrodes 6 and 7, and the middle electrode 3 are all resistively decoupled from DC supplies through R resistors 50, 53, 51, 52 and 23 respectively. Resistors R may be any value from 10 kOhm to 10 Mohm. Capacitor $C_c$ may be any value from 100 pF to 100 nF, $C_t=C_m=C_c/8$. The capacitor values may be adjusted in order to minimize the appearance of ghost peaks at ¼ M/q and ⅓ M/q positions. FIG. 14 is a mass spectrum obtained from the operation of the fourth embodiment (FIG. 13A).

Figure 15:
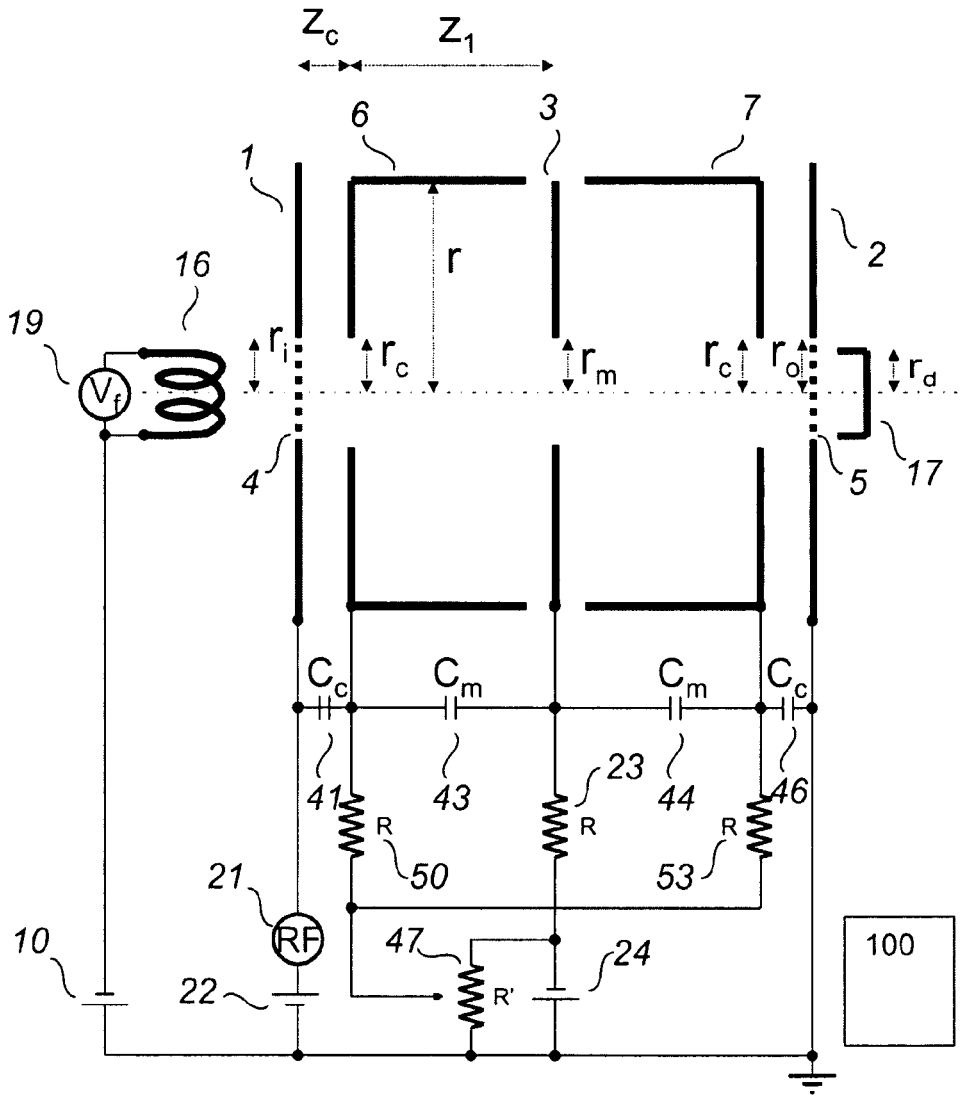
FIG. 15 is a schematic diagram of a fifth embodiment where the trap and compensation electrodes are one. Two cylindrical trap electrodes 6 and 7, of internal radius r, have end caps with apertures each of radius $r_c$. The trap electrodes 6 and 7 are separated from end plates 1 and 2 respectively by the distance $Z_c$.

In the fifth embodiment, described in FIG. 15, the compensation plates are incorporated into the basic cylinder or cup design of the preferred embodiment. This fifth embodiment is best described as one in which trap and compensation electrodes are one. Two cylindrical trap electrodes 6 and 7, of internal radius r, have end caps with apertures each of radius $r_c$. The trap electrodes 6 and 7 are separated from end plates 1 and 2 respectively by the distance $Z_c$.

Ion Filling

It is possible to employ two different ways to fill an electrostatic trap with ions: 1) continuous filling and 2) pulsed filling. The two approaches are described below. Pulsed filling is the standard methodology used in most modern quadrupole ion traps, but is not a requirement for the operation of the anharmonic ion trap systems of this invention. Most early prototypes of anharmonic electrostatic ion traps developed in our lab were used in very high vacuum environments and relied on a continuous ion filling mode for operation.

Continuous Filling

The mode of operation selected for our early prototypes, such as FIG. 3, relied exclusively on a continuous ion filling mode in which electrons are constantly injected into the trap and ions are constantly produced as frequency sweeps take place. This mode of operation is known as continuous filling. Under continuous filling, the number of ions available for ejection during a scan period is determined by the number of ions produced inside the trap or delivered to the trap during the ramp cycle. Under continuous filling there are two basic ways to limit the number of ions in the trap during a scan cycle: 1) limit the rate of ion introduction or ion formation, or 2) increase sweep rate.

Continuous filling makes the most efficient use of the sweep time (i.e. highest duty cycle) since no time is wasted, but can also bring along some complications such as: 1) charge density saturation of the trap under increasing pressure conditions (coulombic repulsion), 2) loss of dynamic range under high ion counts, 3) loss of resolution at higher gas sample pressures. Under continuous filling the intensity of the signal can be controlled by reducing a) the sweep time and/or b) the rate of ion formation or introduction. For example it is not uncommon to reduce both the sweep time and the electron emission current in traps as the pressure of sample gas increases. Continuous filling is best suited for gas sampling applications at very low gas pressures (UHV). As the gas pressure increases, continuous filling requires several adjustments in the mass spectrometer operating conditions in order to maintain adequate mass spectral output and linearity of the individual mass peak signals with respect to pressure. Common experimental approaches include: 1) reduction of the electron emission current and 2) increases in sweep rates and AC drive amplitude. Reduction of the electron emission current can be used to reduce the rate of ion formation in a trap and to limit the number of ions formed inside the trap during a complete sweep cycle. For externally created ions, a comparable reduction in the rate of ions loaded into the trap during a sweep would need to be effected to limit ion density levels. It is not unusual to observe increases in ion signals with increases in scan rates as the pressure starts to exceed $10^{-7}$ Ton and if continuous filling is in place. A side-effect of an increase in sweep rate is a decrease in mass spectral resolution which must be carefully considered during tuning and optimization.

Pulsed Filling

Pulsed filling is an alternative mode of operation in which ions are created inside, or loaded into, the trap during prespecified short periods of time carefully selected to limit the ion densities inside the trap. In its simplest and most common implementation, pulsed filling involves the generation of ions in the absence of any AC excitation: The ions are created and trapped under the influence of purely electrostatic trapping conditions and an RF frequency or trapping potential sweep is then triggered to produce mass selective storage and/or ejection. The process is then repeated again with a new ion pulse filling the trap prior to the sweep. There are multiple reasons to implement such a mode of operation. Pulsed filling has been a standard methodology for the operation of quadrupole-based ion traps for many years and most of the same reasons to use pulsed filling are relevant for anharmonic electrostatic ion traps.

The most important reason to isolate and gauge the process of ion filling is to effectively control space charge inside the ion trap. Even though it is always possible to control the amount of charge by, for example, controlling the electron flux into a trap with an electron impact ionization (EII) source, it is also clear that additional control of space charge build-up could be effected by controlling the duty cycle of ionization. Very large ion concentrations inside a trap can lead to problems such as: peak broadening, resolution losses, lost dynamic range, peak position drifts, non-linear pressure dependent response and even signal saturation.

Another reason to apply pulsed filling will be to better define the initial ionization conditions when doing mass selective storage, fragmentation and/or dissociation. For example, in order to completely clear all undesirable ions from a trap it will be required to stop introducing new ions while the cleaning sweeps take place.

Another reason to apply pulsed filling might be to provide better pressure-dependent operation. Under constant electron emission currents with EII sources, the density of ions generated inside a trap during a sweep will continuously increase with pressure until charge density saturation starts to take place (i.e. $10^{-7}$ Ton typical). This might lead to degradation of trap performance with increasing gas pressure. A reduction in the ionization duty cycle could then be used to dynamically adjust the fill-time duty cycle and the charge densities inside the trap as a function of pressure. Reduced ion densities at higher pressures not only increase trap performance, but also limit the rate of stray ions escaping from the trapping potentials and reaching the detector or other charge sensitive equipment or gauges.

The techniques used to control pulsed ion filling in anharmonic electrostatic ion traps are generally the same as those used for quadrupole ion traps. Anharmonic electrostatic ion traps relying on EII are usually fitted with electron gates to turn the electron beam on/off if slow thermionic emitters are used, or alternatively rely on the fast turn on/off times of cold electron emitters based on field emission to control the duty cycle of the electron fluxes going into the trap's ionization volume. External ionization sources are pulsed and/or ions gated in using standard techniques well known to those skilled in the art.

The ionization duty cycle, or filling time, in pulsed filling schemes can be determined through a variety of feedback mechanisms. There may be experimental conditions under which the total charge inside the trap is integrated at the end of each sweep and used to determine the filling conditions for the next sweep cycle. Charge integration can be done by (1) simply collecting all the ions in the trap with a dedicated charge collection electrode, (2) integrating total charge in the mass spectrum or (3) using a representative measure of total ion charge (i.e. current flowing into an auxiliary electrode) to define ionization duty cycle in the next sweep. Total charge can also be determined by measuring the amount of ions formed outside the trap as the pressure increases (EII sources). There may also be experimental conditions under which it might be beneficial to use independent total pressure information to control ion filling pulses. As is common in many modern residual gas analyzers based on quadrupole mass filters, a total pressure measurement facility could be integrated into the ionizer or trap to provide a total pressure related measurement. Alternatively, pressure measurement information from an auxiliary gauge could also be applied to make the determination. The analog or digital output from an independent pressure gauge, gauges or even an auxiliary Residual Gas Analyzer located somewhere else in the vacuum environment could be interfaced into the anharmonic electrostatic trap mass spectrometer electronics to provide real-time pressure information. There may also be experimental conditions under which it might be beneficial to adjust ion filling times based on the specific mass distributions or concentration profiles present in the last mass spectrum. The duty cycle for ion filling could be adjusted based on the presence, identity and relative concentrations of specific analyte molecules in the gas mixture. There may also be experimental conditions under which the filling times are adjusted based on target specifications for the mass spectrometer. For example, it might be possible to control ionization duty cycles to achieve specific mass resolutions, sensitivities, signal dynamic ranges and detection limits for certain species.

Cooling, Dissociation and Fragmentation

Even though the principles of operation of anharmonic electrostatic ion traps are radically different and simpler than those of quadrupole ion traps (QIT) mass spectrometers, both technologies share common trades based on the fact that both instruments have the ability to mass selectively store, excite, cool, dissociate and eject ions. It is possible to employ anharmonic electrostatic ion traps arranged to act as collision, fragmentation and/or reaction devices without ions ever being mass selectively and or resonantly ejected and/or parametrically ejected form the trap. There may be experimental conditions under which the anharmonic electrostatic ion trap is temporarily used as a simple ion transmission device within a tandem mass spectrometer setup.

Over the last two decades several different techniques have been developed for controlled cooling, excitation, dissociation and/or fragmentation of trapped ions in QITs. Most of those techniques are portable and adaptable to anharmonic electrostatic ion traps and are included in their entirety into this invention.

The ability of anharmonic electrostatic ion traps to store and detect specific ions, based exclusively on their mass-to-charge ratios, could be used to develop specific gas detectors. There may be situations under which trace gas components of a mixture might be concentrated in the trap through repeated and multiple fill and mass-selective-ejection cycles. Specific gas detectors will rapidly find applications in fields such as leak detection, facility and environmental monitoring and process-control sensing for applications such as fermentation, paper manufacturing, etc. The ability to concentrate species of a specific M/q in the trap provides the power to effect high sensitivity measurements.

Ions trapped in an anharmonic electrostatic ion trap usually undergo a large number of oscillations (thousands to millions, mass dependent) before they are ejected from the trap. Large trapping periods are characteristic of the persistent autoresonant excitation which relies on very small drives to pull ions out of deep potential wells. As the ions resonate back-and-forth in the trapping potential they undergo collisions with the residual gases present in the trap and suffer fragmentation. It might be beneficial, in some cases, to add some additional components to the residual gas background to induce further dissociation or cooling of the ions prior to ejection.

Collisionally induced dissociation (CID) is observed routinely in anharmonic electrostatic ion traps with or without the application of autoresonant excitation. The mass spectra generated through autoresonant ejection generally contain fragment contributions to the total spectra relatively higher than what is typically observed in other mass spectrometry systems such as quadrupole mass spectrometers. The additional fragmentation is due to the fact that ions can undergo large numbers of oscillations and collisions in the presence of residual gas molecules. The fragmentation patterns are highly dependent on the total pressure, the residual gas composition and the operational conditions of the spectrometer. Additional fragmentation is generally considered a welcome occurrence in mass spectrometry used for chemical identification since it provides orthogonal information ideally suited for infallible identification of chemical compounds. The ability of mass spectrometers based on autoresonant ejection to control the amount of fragmentation is a very important advantage of this technique. For example, there may be situations in which the frequency sweep for the RF is dynamically controlled to adjust the amount of fragmentation. Fragmentation might be an undesirable feature in some cases such as mixture analysis or complex biological samples. In those cases trapping and ejection conditions will be optimized to minimize fragmentation and simplify spectral output. Reduction in CID can be accomplished through several paths: 1) control the number of oscillations in the trap, 2) control the residence time in the trap and 3) control the axial and radial energy of the ions during oscillation. The energy of the ions is most easily affected by changes in the depth of the axial trapping potential. Changes in residence times and number of oscillations are affected by changes in the amplitude and rate of the frequency sweep. Control of ion concentrations can also be used to modify the amount of fragmentation. The examples presented in this paragraph are just some of the ways in which fragmentation can be effected and controlled and it will be apparent to those skilled in the art how to provide additional fragmentation and CID control paths.

A common methodology in QIT mass spectrometers is to introduce buffer gases into the trap to cool ions and focus them in the center of the trap. The same principles could be applied to anharmonic electrostatic traps. There may be conditions under which it might be desirable to add a buffer gas or gases into a trap during operation. The gas could be injected into both open and closed trap designs. Closed traps offer the advantage of faster cycle times. The added buffer gas could be used to cool down the ions and provide more controlled or focused initial ion energy conditions or to induce additional fragmentation through CID.

Dissociation, cooling, thermalization, scattering and fragmentation are all interrelated processes and those inter-relations will be apparent to those skilled in the art.

Several different processes could be taking place inside an anharmonic electrostatic trap as ion oscillation takes place: CID (Collision Induced Disassociation), SID (Surface Induced Disassociation), ECD (Electron Capture Disassociation), ETD (Electron Transfer Disassociation), Protonation, Deprotonation and Charge Transfer. Such processes are intrinsic to the mode of operation and many different applications exist in which they might need to be enhanced or mitigated.

Ion-trap CID could be used to apply anharmonic resonant traps to provide MS" capabilities. The trap could be filled with a mixture of ions and some means of autoresonant excitation could be used to selectively eject most ions. The remaining ion or ions of interest are then allowed to oscillate in the trap for an period of time providing additional fragmentation. The fragments are finally ejected and mass analyzed with a second frequency sweep to provide $MS^2$ information. The potential to provide MS″ capabilities within a single trap is a definite advantage of mass spectrometry based on anharmonic electrostatic ion traps relative to competitive techniques such as linear quadrupole mass spectrometers. The basic operational principles of MS″ operation in traps will be apparent to those skilled in the art. It might be desirable to add external excitation sources, such as optical radiation to produce photochemically induced changes in the chemical composition of the trap prior to ejection.

Mass Spectrometry with Anharmonic Electrostatic Ion Traps

FIG. 13A is our latest embodiment for the fabrication of a mass spectrometer based on an anharmonic electrostatic ion trap, relying on EII for the internal ionization, and autoresonant ejection of ions for spectral output generation. Electrons, 18, are emitted from a hot filament, 16, and accelerated towards the left port of the trap, 4, by an attractive electrostatic potential. An open port, 4, (perforated plate or metal grid) provides a permeable access point for the electrons. The electrons penetrate the trap volume and turn around as they climb uphill into the negative axial trapping potential generating a narrow band ionization volume within the trap and close to the entry port. Mostly positive ions are created inside the trap, which immediately start to oscillate back-and-forth in the axial direction with their motion dynamics defined by an anharmonic negative trapping potential well. The initial ion energies are defined by their point of origin within the electrostatic potential well. Ion filling is continuous in this particular implementation when UHV gas sampling is performed. Positive ion storage is used for ion trapping and detection. Typical trapping potentials for traps with dimensions <2 cm will be between −100 and −2000 Volts though both shallower and/or deeper trapping potentials sometimes required. Typical electron emission currents are <1 mA and electron energies typically range between 0 and 120 V. The implementation of FIG. 13A relies on a thermionic emitter as a source for the electron gun; however, it should be apparent how to replace the hot cathode with a modern cold cathode emitter source to provide lower operational power, cleaner spectra (free of thermal decomposition fragments) and possibly longer operational lifetime. The implementation of FIG. 13A relies on continuous ionization since it does not include means to rapidly control electron emission rates, though it should be apparent (based on technologies readily available for QITs) how to implement pulsed electron injection schemes using electron gun gating. A continuous electron flux into the trap (continuous filling) provides a maximum ion yield for most pressures.

Ion ejection in FIG. 13A is effected by means of a low amplitude (about 100 mVp-p) frequency chirp as delivered by off-the-shelf electronics components. Logarithmic frequency ramps have been routinely applied in our lab for best spectral quality and peak uniformity. The highest frequencies (typically in the MHz range) are responsible for the ejection of light ions. Lower frequencies (KHz range) are responsible for the ejection of the heavier ions.

High frequencies will eject mass 1 (hydrogen) first. (There is no lower mass ion to detect.) For a trap ~3 cm long the highest useful frequency is therefore ~5 MHz. This is then ramped down to (in practice) ~10 kHz. (i.e. >2 decades frequency sweep). This will allow an ART MS user us to interrogate masses between 1 and 250,000 amu (atomic mass units).

Most of our lab prototypes have relied on non-linear frequency scans, which ensure equal numbers of oscillations during the ejection stages of successive ions regardless of their mass. The phase purity is important. RF generation in our lab prototypes relies on the use of direct digital frequency synthesizer chips from Analog Devices and low power simple microcontrollers. Logarithmic frequency sweeps are typically pieced together as a succession of linear frequency sweeps with decreasing rates.

The mass range of a mass spectrometer based on autoresonant ejection from an anharmonic electrostatic ion trap is theoretically unlimited. The sweep rate for the frequency chirp is often slowed down as the masses ejected increase to provide more uniform looking peak distributions in the spectral output. Scan repetition rates, have been as high as 200 Hz, with an upper limit defined only by the current capabilities of our data acquisition systems used to collect data in real time.

The simple embodiment of FIG. 13A relies on an electron multiplier device to detect and measure the concentrations of the ions ejected from the trap. An electron multiplier is a detector commonly used in most mass spectrometers to amplify ion currents exiting the mass analyzer. Ejected ions are attracted to the entrance of the electron multiplier, where collision with its active surfaces causes the emission of electrons through a secondary ionization process. The secondary electrons are then accelerated into the device and amplified further in a cascaded amplification process which can produce ion current gains in excess of $10^6$. Electron multipliers are essential for ion detection in ART MS instruments used at pressure levels extending into UHV levels. Detection limits can be further extended to lower pressures and concentration values by implementing pulse ion counting schemes and using specially optimized electron multipliers and pulse amplifier-disciminators connected to multichannel scalers. There is a large variety of electron multiplier devices available to mass spectrosocopists most of them being fully compatible with the mass spectrometers based on anharmonic electrostatic traps and autoresonant ejection. Some of the available detection technologies include: microchannel plates, microsphere plates, continuous dynode electron multipliers, discrete dynode electron multipliers and Daly detectors. Microchannel plates offer some very interesting potential design alternatives for the design of traps since it might be possible to incorporate their entry surfaces in to the exit electrode structures. The output of the multiplier can be collected with a dedicated anode electrode and measured directly as an electron current proportional (i.e. high gain) to the ion current. Alternatively, phosphors and scintillators can be used to convert the electron output of the multipliers into optical signals. For Megadalton (greater than 1000,000 amu) detection, charge sensitive detectors might be considered when the conversion efficiency of electron multipliers is just too low to produce useful signals, as described in Stephen Fuerstenau, W. Henry Benner, Norman Madden, William Searles, U.S. Pat. No. 5,770,857.

Figure 13B:
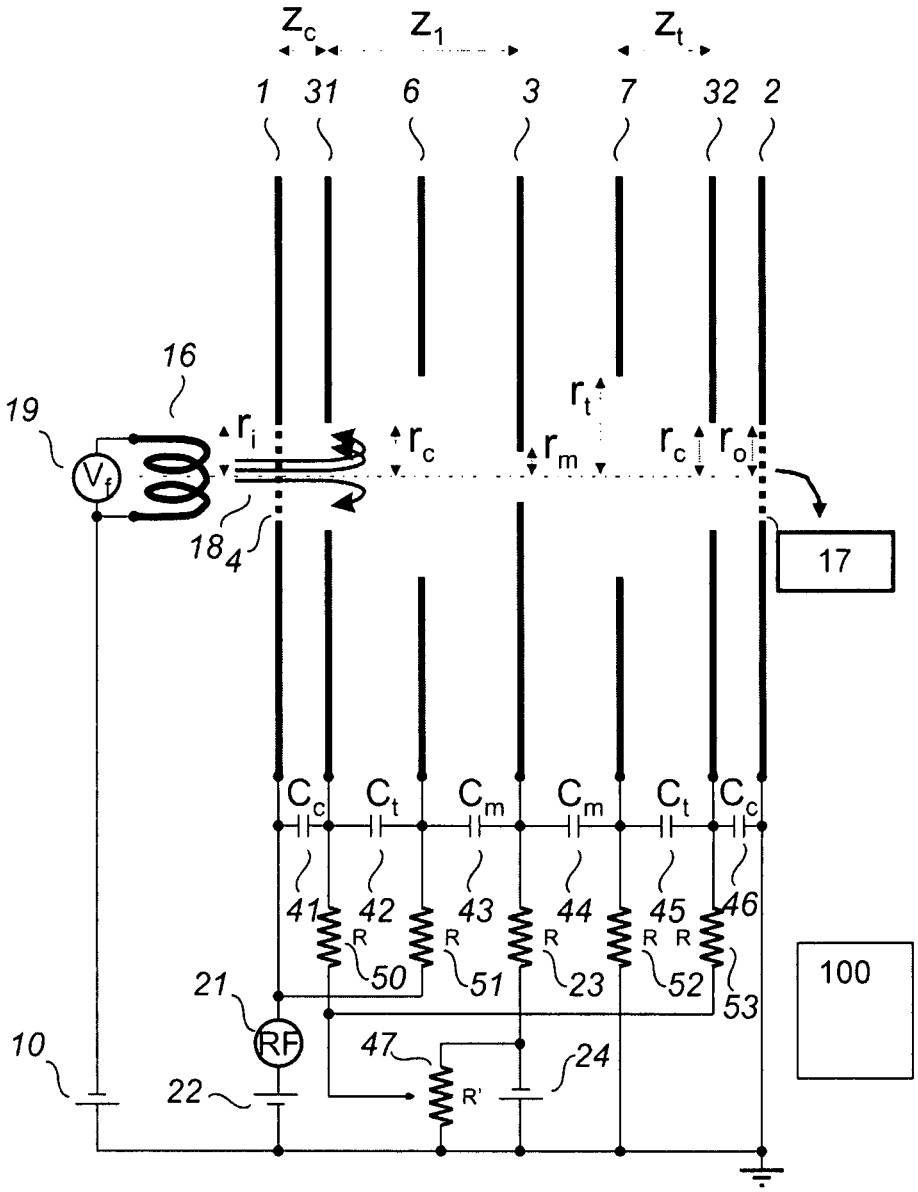
FIG. 13B is a schematic diagram of an embodiment of the electrostatic ion trap with an off-axis detector.

The detector in FIG. 13A is located along the axis of ion ejection. This detector has direct line of sight into the trap along the oscillation axis of the ions. In order to minimize spurious ion counts and signals due to electromagnetic radiation emanating from the trap, ion detector(s) may be mounted off axis as depicted in the further embodiment of FIG. 13B. This approach is commonly used if stray light may be considered a potential source of noise (apparent non mass resolved signal.) In these circumstances it is customary to deflect and accelerate ions to the leading surface of a detector. The electrostatic biases that are applied to deflect ions may be reversed to allow for detection of positive or negative ions, may be adjusted to optimize ion detection, or may be readjusted to allow transmission of ions away from the detector and trap. If the deflection biases can be modified sufficiently rapidly the mass spectrometer can be utilized as a pulsed ion-selective source. The normal mass spectrum can be generated only intermittently, to act as a monitor of the ion beam source. Alternatively it is possible to use microchannel plates with central holes lined up with the exit aperture of the trap but only biased when detection is required. Such custom multipliers are common in coaxial reflectron time of flight mass spectrometers and allow the development of compact combination pulse ion sources and mass spectrometers. Ions ejected from the trap will clear the central hole while no bias is applied to the detector, or will be diverted electrostatically to the front surface of the plate for detection when biases are applied.

Even though electron multipliers have been used for all the mass spectral measurements performed in our lab, it will be apparent to those skilled in the field of mass spectrometry that there is a large variety of possible detection schemes that might be compatible with this novel ion trap technology which do not necessarily include ion current amplification. Some examples might include the use of Faraday cup detection (i.e. no amplification), or even the electrostatic pickup of image charges using internally or externally mounted inductive pickup detectors. While using inductive pickup it might be possible to detect the passage of ions directly or by means of FFT spectrum analysis technologies. The anharmonic electrostatic ion trap configuration of FIG. 13A relies on detection of ions on one single end of the trap—i.e. half the ions are lost as they are ejected in the opposite direction. If the trapping potential is symmetric only ions ejected through the right electrode of FIG. 13A, 2, (exit electrode) will contribute to the output signal. It might be desirable to add a dual detection scheme in which ions are picked up at both ends of the trap (see FIGS. 9A-9B). It is also easy to justify the reasons to direct most of the ejected ions to port 2, in which case the signal and sensitivity will be enhanced. Introducing asymmetries in the trapping potential has been used, DC Bias 22, in order to effect preferential ejection through the port 2 with the detector.

An alternative detection scheme could include careful monitoring of the RF power required to maintain a fixed amplitude during frequency sweeps. Even though the energy pumping mechanism is a persistent process that starts at high frequencies, the rate of acceleration of ion oscillations increases at it highest rate as the RF frequency crosses the natural resonant frequency of the ions. Careful attention to the amount of AC drive power pumped into the trap could be used to detect the frequencies at which energy is pumped into the ions and that information could then be used to derive the mass and abundance of ions at each active frequency.

The simple schematic of FIG. 13A is a close representation of the simple prototype mass spectrometer instruments that have been built in our lab based on anharmonic electrostatic ion traps and autoresonant ejection of ions. As the pressure in the system increases it will be necessary to adjust to the effects of stray ions which might contribute background counts, and diminish the dynamic range, of the mass spectrometer. Stray ions originate from many different sources: 1) ions are formed by EII outside the trap as the electrons are accelerated towards the entry plate, 2) ions exit the electrostatic linear ion trap radially since radial confinement is not 100% efficient. In order to prevent stray ions from reaching the detector and producing stray background signals, it will generally be needed to add shields to isolate the ionizer and detector. In principle, only ions ejected from the trap in sync with the RF sweep should be able to reach the detector and count as signal. The problem of stray ions contributing to the background is not unique to ART MS and the most effective solutions will be apparent to those skilled in the art.

The typical mass spectrometer based on anharmonic electrostatic ion traps and autoresonant ejection requires very low power (mW range excluding ionizer requirements) because it uses only electrostatic potentials and very small RF voltages (100 mV range). Such low RF amplitudes should be compared to the requirements of QITs and quadrupole mass filters in which the mass range of the device is often limited by the ability to deliver and hold high voltage RF levels into the mass analyzer. Very high sensitivities are possible extending the detection limits of the mass spectrometers into the UHV range (i.e. $<10^{-8}$ Torr.) High data acquisition rates are also a very important feature of this technology. Frequency sweep rates as high as 200 Hz have been demonstrated in our lab, with the upper limits being currently bracketed only by the bandwidth and data acquisition rate limits of our general purpose electronics. Higher sampling rates should be easily achievable with faster data acquisition systems, providing full spectral output at rates in excess of the 200 Hz demonstrated in our lab. Such performance is not readily available from any of the modern commercially available mass spectrometers typically used for Residual Gas Analysis, and makes this novel mass spectrometry an ideal candidate for the analysis of fast transient signals as for example, the output of chromatographic systems, ion mobility spectrometers and temperature programmed desorption studies (TPD).

The small dimensions, low power requirements and low detection limits of the device make this novel mass spectrometry technology most ideally suited for the implementation and construction of portable, remotely operated and stand-alone MS-based sampling systems. Mass spectrometry based on anharmonic electrostatic ion traps will naturally find a home in remote sensing applications extending from underwater sampling to volcanic gas analysis to in-situ environmental sampling. Mass spectrometry based on anharmonic electrostatic ion traps is also an excellent candidate for the development of deployable, battery operated instrumentation for the detection of hazardous and or explosive materials in the field. In fact, mass spectrometry based on anharmonic electrostatic ion traps is believed to provide the first tangible opportunity to develop wearable mass spectrometers which do not need to rely on expensive miniaturization manufacturing techniques and which provide mass analysis specifications comparable to those of bench-top instruments.

Sample Mass Spectra

The large majority of tests performed to date in our lab have relied on low pressure operation—i.e. $<10^{-7}$ Torr and EII sources; however, the applicability of the technique has been demonstrated for pressures into the mid $10^{-5}$ Torr region.

With proper instrument optimization, mass spectrometry based on anharmonic electrostatic ion traps is expected to provide useful mass spectra for large pressure ranges and for essentially any chemical species that can be ionized and loaded or transferred into the trap. It has been generally observed that ion filling and scanning conditions will need to be parametrically adjusted according to the pressure of operation to obtain smooth operation and linearity of quantitative response over wide pressure ranges. A large number of different instrumental setups could be used to provide auto-tuning of trap operational parameters based on total pressure, residual gas composition and/or target performance parameters.

Under standard operational modes, mass spectrometers based on anharmonic electrostatic ion traps will typically display mass spectra with peaks of constant relative resolution, $M/\Delta M$. Resolution powers in excess of 100× have been readily achieved in our lab with traps of small dimensions such as in FIG. 13A. The resolution power, $M/\Delta M$, depends on the specifics of the design, but is not dependent on the mass analyzed. As a result, spectral peaks for low masses are much narrower (lower $\Delta M$) than peaks at higher masses. The excellent absolute resolution, $\Delta M$, of the device at lower masses makes the sensing technology ideally suited for isotope-ratio determinations, for leak detection based on light gases and for fullness measurements in cryogenic pumps. The mass independence of the relative resolution has been verified in our lab and is a direct consequence of the principle of operation of the device.

Mass axis calibration in mass spectrometers based on anharmonic electrostatic ion traps is very straightforward. Ejection frequencies are closely proportional to the square root of the trapping potential and inversely proportional to the length of the trap. For fixed geometry and trapping potential, the ejection frequency of an ion is related to the square root of its M/q. Mass calibration is generally performed at a single mass, linking its ejection frequency to the square root of the mass though mass axis calibration slope and intercept parameters, the square-root dependence between mass and frequency is then used to assign masses to all other peaks in the frequency spectrum. The same methodology is generally applied regardless of the functional form of the frequency sweeps. For high accuracy mass spec determinations it might be necessary to incorporate higher order terms into the calibration curve to account for non-linearities in the square root response.

Direct comparison of mass spectra against equivalent spectra generated under the same environmental conditions but applying alternative mass spec technologies will generally reveal some fundamental differences stemming from the different modes of operation of the two devices. A mass spectrometer based on anharmonic electrostatic ion trap generally experiences a larger degree of fragmentation than equivalent spectrometers based on quadrupole mass filters. Whereas in most linear quadrupole systems fragmentation is a collateral consequence of the electron impact ionization processes, the additional collisions between the ions and residual gas molecules in the electrostatic linear ion trap cause the ions to undergo further fragmentation after the ions are trapped. The additional fragmentation must be kept in mind during the selection of operational parameters and also while using spectral libraries to perform gas species identification. The relative sensitivity to different chemical species will depend on a large number of parameters. In addition to the gas specific ionization efficiencies of the different gases present in a mixture, it must also be considered that the number of oscillations and residence times for different ions in a trap will be mass dependent. The species dependence of the sensitivity for different gases will be linked to the details of the ionization scheme and the ion ejection parameters.

External calibration will generally be required to produce quantitative results during concentration determinations. Matrix effects will also be present in the traps since it is expected that large changes in the relative concentrations or amounts of matrix gases might affect other analyte signals in a mass spectrometer. Users will need to choose the most adequate means to calculate peak intensities in order to perform quantitative measurements. Several different schemes have been used in our lab, and many different variations and extensions of these ideas should be apparent to those skilled in the field of mass spectrometry. In a simple analysis situation, locating the main peaks and measuring their peak intensities could be all that is required. Alternatively, there may be experimental conditions where integration of the ion signals might be a better way to produce quantitative results in light of the longer resident times of heavier ions in the trap. In some experiments we have found it necessary to multiply the intensities of the signals in the mass spectra by a mass-dependent coefficient. The mass speaks are generally fairly symmetric and using the peak maximum is generally all that is required to provide adequate mass assignments. In some situations, however, peak centroids might be necessary for additional accuracy. Spectral deconvolution methods, based on matrix inversion algorithms, have been used successfully to analyze complex spectra originating from multiple gas components from mass spectrometers and their use should also be beneficial. In some applications it might be necessary to normalize mass spec data to other external signal levels, such as total pressure, to provide better quantitative results and extended linearity over a large pressure range.

Figure 16A:
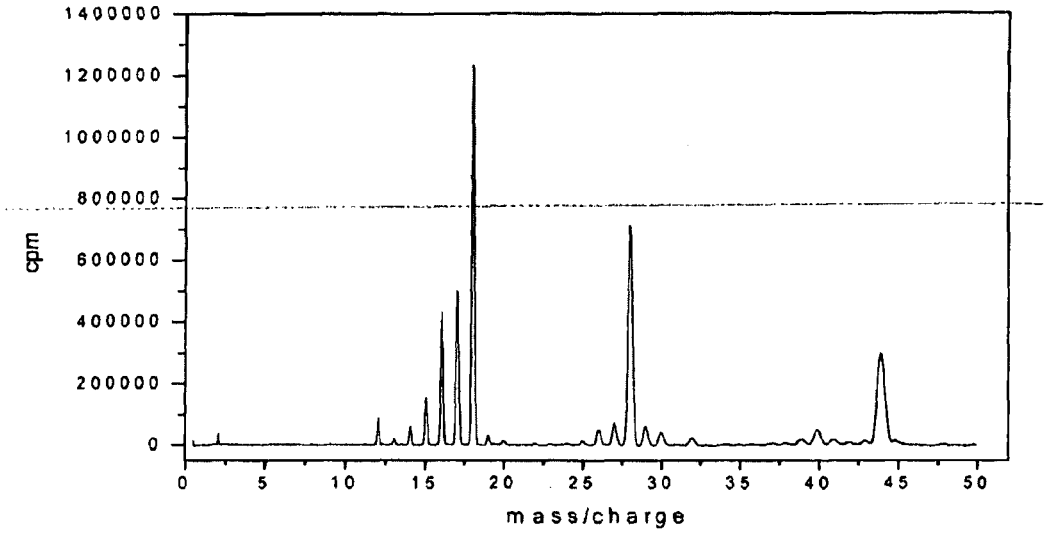
FIGS. 16A and 16B are drawings of sample mass spectrum of background gases at $3\times10^{-9}$ Torr. Scale FIG. 16A×1. Scale FIG. 16B×10.
Figure 16B:
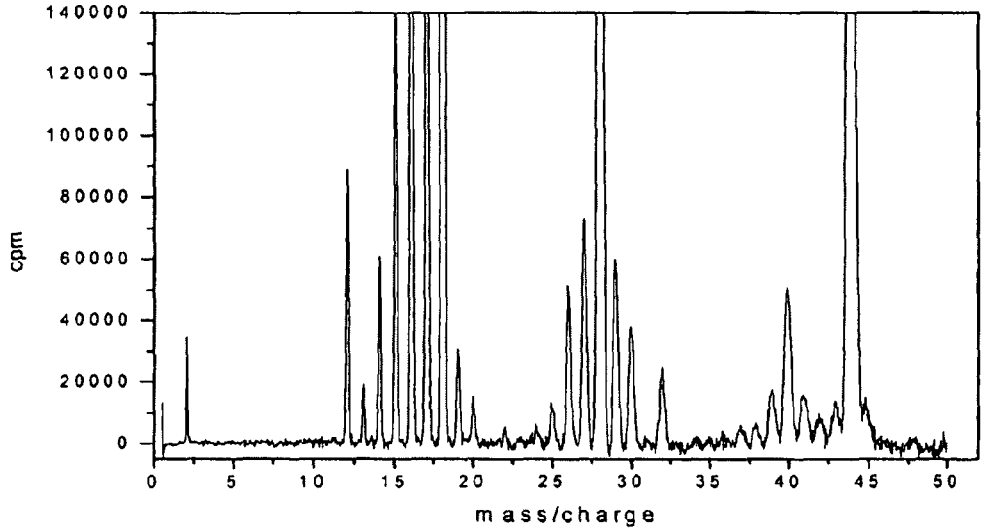
Figure 17:
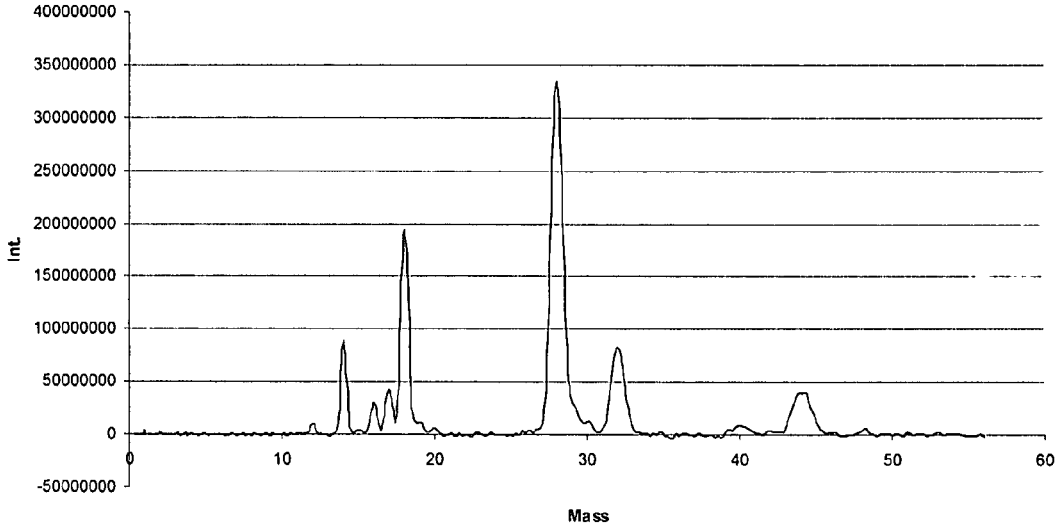
FIG. 17 is a drawing of a mass spectrum of air at $3\times10^{-7}$ Torr. Air was injected through a leak valve into a turbopumped system with an early prototype of ART MS, showing the nitrogen and oxygen peaks (28 and 32 amu respectively).
Figure 18:
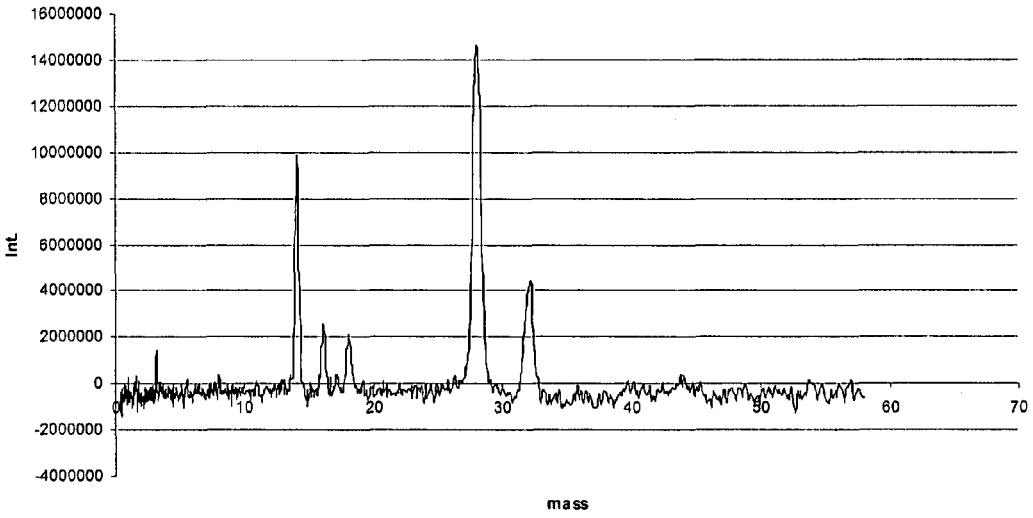
FIG. 18 is a drawing of a spectrum of air at $3\times10^{-6}$ Torr. Air was injected through a leak valve into an evacuated system with an early prototype of ART MS. Performance was optimized for resolution. The effects of stray ions on background signals start to become evident at these pressures.
Figure 19:
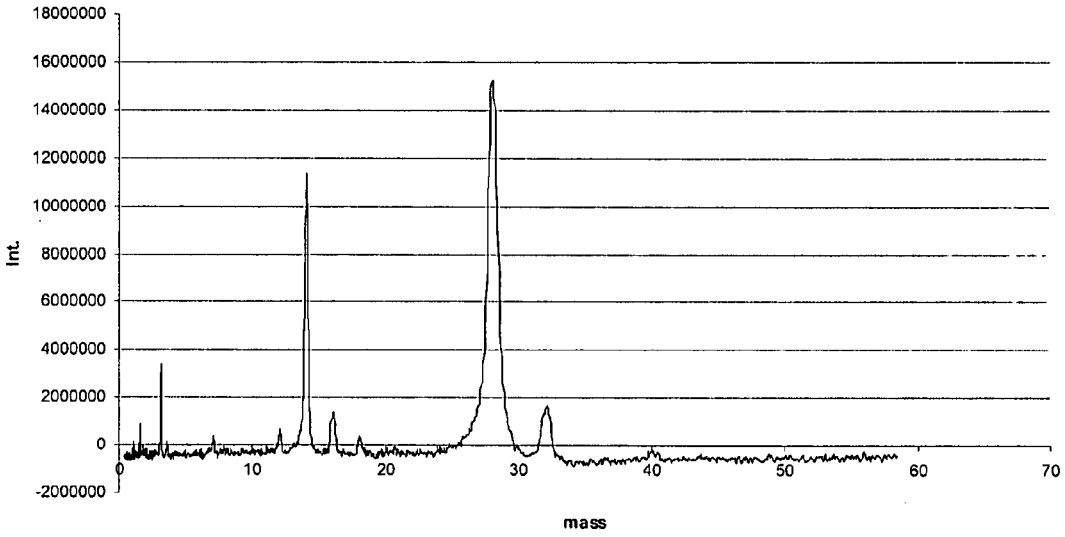
FIG. 19 is a drawing of a spectrum of air at $1.6\times10^{-5}$ Torr. Air was injected through a leak valve into an evacuated system with an early prototype ART MS.
Figure 20:
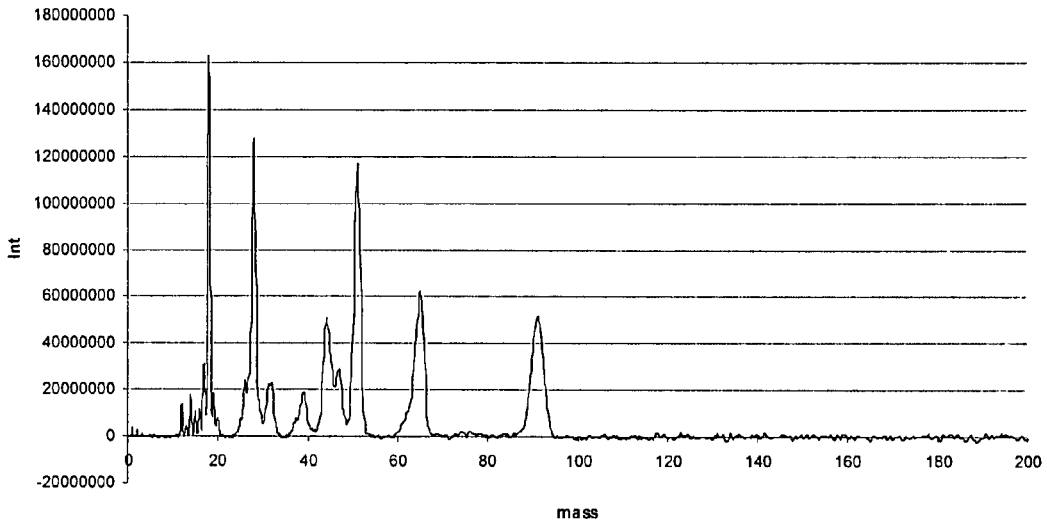
FIG. 20 is a spectrum of toluene in air at $6\times10^{-7}$ Torr. Toluene gas was vaporized into air and the mixture directly injected through a leak valve into an evacuated system with an early prototype of the ART MS.

The sensitivity of compact mass spectrometers based on anharmonic electrostatic ion traps is demonstrated by FIG. 16. The operation of the traps at pressures as high as $3.10^{-5}$ Torr has been observed and preliminary results, without instrument optimization, are available in FIGS. 17-19. The ability of the device to detect complex chemicals is demonstrated in FIG. 20.

Operation of mass spectrometers can be limited at high gas pressures due to scattering of confined ions with neutral species of the residual gasses within the trap. Scattering scrambles the ion energy, and directionality of motion of the ions. The scattered ions may remain confined, but they may no longer be ejected from the trap in the current ramp cycle of RF frequency (or of bias voltage,) alternatively they may be expelled from the trap before they would in the absence of scattering. Expulsion of ions in the x or y directions leads to a loss of signal. Premature expulsion in the z direction (to the detector) may lead to an unwanted (featureless) background signal and background noise levels in the mass spectrum. Neutral-ion scattering is thus an undesirable consequence of operation at high working pressures during the operation of an anharmonic trap as a mass spectrometer. At high operation pressures apparent cracking ratios are affected, and finally the sensitivity is much reduced. At high pressures, exceeding typically ~10−6 Torr, we have even seen decreasing signal levels with increasing pressure which require tuning of the trap scan conditions to adjust mass spectrometer parameters.

Neutral-ion scattering cross sections are slowly varying functions of ion energy. Thus, at a given operating pressure, the probability of ion scattering is largely dominated by the integral distance the ion travels within the trap. This, in turn, is determined by the instantaneous velocities (and/or energies) of ions within the trap and the duration of ion confinement. Ion-neutral scattering can thus be reduced by (1) increasing the ramp rate of the RF frequency, or (2) increasing the ramp rate of the middle electrode bias, depending on the means of operation of the trap for generation of mass spectra. Viable ramp rates are limited by the RF amplitude (threshold control), so increasing of the latter can aid still further in reduction of the time of ion confinement. The alternative approach, to minimizing the ion travel distance with in the trap, is to decrease the span of ion velocities required for ion ejection. This can be done, in RF frequency scanning mode, by reducing the middle electrode voltage. In the mode of operation that uses scanning of the middle electrode voltage, then the values within the required range of middle electrode biases, and ion velocities, can be reduced by operating at a lower (fixed) RF frequency. When the middle electrode bias falls below an electron filament potential, electrons may travel throughout the trap. Ionization could then, in principle, occur significantly within both halves of the trap.

Operation of a trap at lower RF frequencies or faster scan rates does have the disadvantageous effect of decreasing the resolving power. An alternative means of decreasing ion travel distance is to decrease the lateral dimensions of the trap. In those circumstances, the same RF frequencies may be employed while enhancing the linearity of the response at higher pressures without the decrease of resolving power. Other potentially detrimental effects on resolving power, sensitivity and/or linearity can occur through ion-ion scattering and space charge effects. These problems can be mitigated by operating with fewer ions within the trap. Fewer ions may be injected into the trap, or a less efficient in situ ionization means can be employed. As examples, electron emission currents, filament biases, ionizing photon fluxes, or metastable neutral fluxes may be reduced. However, under normal operating (low gas pressure) conditions, the sensitivity of the mass spectrometers are generally increased by increasing the ion generation.

Mass Spectrometry Applications

ART MS provides a new way to perform mass spectrometric analysis. The simplicity of the assembly, low power consumption, small geometrical scale, fast scan speed, high sensitivity and low manufacturing cost makes it possible to justify ART MS detection in applications where mass spectrometry was previously not practical or just too expensive.

The small size of the electrostatic linear ion traps combined with minimal electronics requirements and low power consumption makes ART MS the ideal sensing technology for sampling and analysis applications requiring portable, field deployable, battery operated and/or wearable gas analysis instruments. The ability to carry out gas analysis with high sensitivity at UHV pressures, makes it possible to build highly portable vacuum systems which rely on compact ion and/or capture pumps and do not require any noisy bulky and energy consuming mechanical (throughput) pumps. A few specific applications of ART MS technology are listed in this section as reference only. The rest of the potential applications of ART MS spectrometers will be apparent to those skilled in the art.

Residual Gas Analyzer (RGA)

Most commercially available RGAs rely on quadrupole mass filters to generate mass spectra. The mass range of a quadrupole mass filter is ultimately limited by the dimensions of the device and the RF drive required to extend the range into higher masses. ART MS technology has the potential to replace quadrupole based RGA technology in a large variety of applications extending from base pressure qualification, surface analysis (TPD) and process analysis/control. It is possible to employ a wide range of ART MS spectrometers in semiconductor chip manufacturing facilities, with gas analysis at both base and process pressures becoming an essential component of the process control data stream for the facility. It is also possible to imagine a whole new generation of smart/combination gauges for the semiconductor manufacturing industry including gauge combinations such as: ART MS, capacitance diaphragm gauges, ionization gauges and thermal conductivity gauges—all integrated into single/modular units. ART MS spectrometers can be used to sample at all possible process pressures with the help of closed electrostatic linear ion trap designs and differentially pumped open ion trap designs. The small number of signals required to run the device combined with low power requirements makes it possible to locate sensors away from the drive electronics and perform measurements directly at the point of interest (i.e. without being a victim of pressure gradients caused by reduced conductance paths between the wafers and the gauge)

Specific Gas Detector

Even though the full power of ART MS is based on its ability to deliver full mass spectra data, ART MS gas analyzers could also be dedicated to monitoring specific gases. There are many different conditions under which it might be required to monitor a specific gas in a system and a dedicated single gas detector might be a better choice. For example, it is known to be useful to track SF6 levels in a High Energy Ion Implanter used for semiconductor processing. SF6 has a very damaging effect on wafers and is very easily ionized by EII or Electron affinity capture. Single gas detection might seem to unnecessarily choke the full potential of an ART MS system, but in reality, focusing on a single species makes it possible to simplify trapping and ejection conditions and optimize performance and speed to detect targeted chemicals in real time and with high sensitivity. ART MS instrumentation could also be configured to detect and track the levels of a fixed group of specific gases, i.e. more than one. For example, ART MS sensors could be used in volcanic sites to test for some of the common species present in fumaroles while looking for signs of increased volcanic activity.

Leak Detector

Leaks are a big problem in vacuum chambers, particularly in vacuum systems that are routinely exposed to air. An in situ ART MS could be used to 1. provide early detection of leaks, 2. to perform preliminary tests of residual gases to differentiate leaks from simple outgassing issues and 3. to perform helium leak detection. A dedicated ART MS should be a standard component of each and every vacuum system. It is common knowledge amongst vacuum practitioners that knowing what is present in the residual gas of a vacuum system is often as important or sometimes even more important than knowing the total pressure. For example, there is no need to wait for gas components that have no effect on a process to pump out from a chamber. The compactness of ART MS makes the sensor also naturally compatible with portable leak detectors which have traditionally relied on small, low resolution magnetic sectors or complicated QITs.

Cryopump Fullness Gauge

Cryopumps are storage pumps and as such have only limited capacity. There is a need to develop chemical sensors capable of detecting the early signs of full capacity in cryopumps. A pump filled to capacity will need to be immediately regenerated using a lengthy and complicated procedure to restore its pumping speed. There is a critical need for gauging of pump fullness so that adequate planning and preparation can be executed prior to a regeneration cycle. Outgassing measurements at the pump chamber have been described as an effective way to detect early signs of fullness. For example, elevated helium, hydrogen and/or neon levels might be useful early signs of fullness. Even though the incorporation of mass specs into cryopump chambers has been considered on many occasions, the cost effectiveness of such solutions has never been validated. ART MS provides a fresh opportunity to rectify that situation. Production facilities (i.e. semiconductor manufacturing facilities) could be designed in which each cryopump is fitted with its own/dedicated ART MS and the output of the sensor is used to make fullness determinations. ART MS instruments are fast, sensitive and have excellent resolution at low masses as desirable for this application.

Temperature Programmed Desorption Studies

Temperature programmed desorption (TPD) measurements are the commonly performed in surface analysis. Most surface analysis experiments involving the study of interactions between specific molecules and substrates, are started by performing gas adsorption of some layers of gas molecules on the substrate followed by fast temperature ramp cycles to thermally desorb the molecules and to provide information regarding binding energies and reactivities between the gas and that substrate. During a TPD scan, the temperature of the substrate is ramped fast and the gases evolved are detected and analyzed. There is a need for mass spectrometer sensors placed in close proximity to the substrate and with the ability to provide fast full spectral analysis. ART MS is probably the best mass spectrometry technique ever developed for this application. ART MS spectrometers are ideally suited for temperature desorption as well as for optical desorption and laser ablation studies commonly used in surface analysis labs.

Isotope Ratio Mass Spectrometry:

Isotope ratio measurements are routinely performed by means of mass spec analysis techniques in both lab and field environments. Whenever possible filed tests are preferred since sampling problems are eliminated. ART MS provides fast and high resolution measurement capabilities compatible with many of the modern isotopic measurement requirements. ART MS is expected to have its highest impact in field deployable IRMS instrumentation. As an example, ART MS could be employed in in-situ volcanic gas sampling or oil well sampling of He-3/He-4 ratios routinely used to gauge volcanic activity and well conditions.

Portable Sampling Systems

The combined advanced features of ART MS: (1) compactness, (2) low power consumption and (3) high sensitivity make this new technology ideally suited for the development of portable gas analysis systems. ART MS spectrometers could replace traditional mass spectrometers such as quadrupoles and magnetic sectors in most field and remote sampling applications in which mass spectral analysis is required but only a very limited power budget is available. ART MS spectrometers will find applications in all areas of gas analysis including: dissolved gas sampling (oceanographic and benthic research), volcanic gas analysis, VOC analysis in water and air samples, environmental monitoring, facility monitoring, planetary sampling, battlefield deployments, homeland security deployments, airport security, sealed container testing (including FOUPS), etc. The deployment opportunities include all field applications requiring batteries or solar panels for power as well as portable devices to be carried by emergency-response and military personnel for the purpose of identifying hazardous or explosive chemicals, and devices mounted on space probes destined to remote planets. The simplicity of the electrical connections and mechanical assembly, the robustness of the electrode structure and the insensitivity of the ion ejection mechanism to the exact anharmonicity of the trap potential makes ART MS spectrometers perfect candidates for applications in the presence of vibrations and high acceleration forces. ART MS spectrometers will rapidly find applications in space exploration and upper atmosphere sampling missions.

Perhaps one of the most versatile and powerful implementations of a portable ART MS sampling system involves the combination of a very small ART MS spectrometer with an ion pump and/or a Getter (NEG Material) pump of small physical dimensions to implement an ultralow power gas sampling device. The ART MS could be fitted with a radioactive source or a cold electron emitter. A pulsed gas inlet system would allow short samples of gas to be introduced into the system for analysis followed by a rapid pump down process between sample cycles. Alternative continuous sample introduction setups could also be applied such as selective membranes (MIMS Technology) and leak valves. The remote portable sensors could be used as standalone mass-spec sampling systems or as back ends for portable chromatography systems. The capabilities of portable GC/MS systems to provide fast analysis results in emergency response situations, including poisonous or hazardous gas releases in public areas, has been demonstrated over the last decade and ART MS provides an opportunity to further minimize the size and power consumption of the sampling devices that are currently available. It is also to be expected that ART MS spectrometers will be combined with ion mobility spectrometers to provide new analytical approaches for the detection of explosive, hazardous and poisonous gases at airports and other public facilities.

Process Analysis

Low cost will be the largest driver propelling ART MS into process analysis applications. There is a large list of chemical and semiconductor processes that could benefit from the gas specific information provided by a mass spectrometer. However, cost of ownership and high initial investment costs have generally conspired against the widespread adoption of mass specs in semiconductor and chemical processing industries. Semiconductor manufacturing tools often rely on total pressure information to define go-no-go rules and to evaluate contamination levels in systems. It is well known throughout the semiconductor manufacturing industry that partial pressure information could be used to reduce cost of ownership of tooling, to improve yields and to reduce downtime in fabrication facilities. However, the cost of mass spectrometers has not been fully justified in the semiconductor industry and mass specs have mostly been relegated to a few specific applications and sites. ART MS has the potential to change this situation by offering the first real opportunity to develop low-cost gas analyzers for the semiconductor industry. Entire product lines could rely on combinations of sensors including total and partial pressure measurement capabilities to fully analyze and qualify bake-out and process conditions. In situ mass specs, directly immersed into process chambers will find applications in traditional RGA analysis during bake-out and process and will also be used for additional applications such as leak detection and single gas detection.

While this invention has been particularly shown and described with references to example embodiments thereof, it will be understood by those skilled in the art that various changes in form and details may be made therein without departing from the scope of the invention encompassed by the appended claims.

What is claimed is:

1. An ion trap comprising:

an electrode structure that produces electrostatic potentials that confine ions both axially and radially to trajectories at natural oscillation frequencies, the confining axial potential being anharmonic;

an AC excitation source having an excitation frequency and connected to at least one electrode of the electrode structure; and a scan control that reduces a frequency difference between the AC excitation frequency and the natural oscillation frequencies of the ions to achieve autoresonance.

2. The ion trap of claim 1, wherein the scan control is configured to continue to scan the excitation frequency from a high frequency to a lower frequency to decrease a difference in frequency between the excitation frequency and the natural oscillation frequencies of the ions while maintaining autoresonance, with energy being pumped from the AC excitation source to the ions, wherein the increase in energy causes an increase in the oscillation amplitude of the ions.

3. The ion trap of claim 1, wherein the scan control is configured to sweep the AC excitation frequency in a direction from a frequency higher than initial natural oscillation frequencies of the ions towards a frequency lower than the initial natural oscillation frequencies of the ions.

4. The ion trap of claim 1, wherein the scan control is configured to sweep the magnitude of the electrostatic fields in a direction such that the natural frequencies of oscillation of the ions sweep from a frequency lower than the frequency of the AC excitation source towards a frequency higher than the frequency of the AC excitation source.

5. The ion trap of claim 1, wherein the electrode structure includes a first opposed mirror electrode structure and a second opposed mirror electrode structure and a central lens electrode structure.

6. The ion trap of claim 1, wherein the confined ions have a plurality of energies and a plurality of mass to charge ratios.

7. The ion trap of claim 6, wherein the AC excitation source is configured to have an amplitude that is at least three orders of magnitude smaller than absolute magnitude of a bias voltage applied to the central lens electrode structure.

8. The ion trap of claim 6, wherein the natural oscillation frequency of the lightest ions in the ion trap is between about 0.5 MHz and about 5 MHz.

9. The ion trap of claim 5, wherein the first opposed mirror electrode structure and the second opposed mirror electrode structure are biased unequally.

10. The ion trap of claim 5, wherein the mirror electrode structures are shaped in the form of cups, open toward the central lens electrode structure, with centrally located bottom apertures and the central lens electrode structure is in the form of a plate with an axially located aperture.

11. The ion trap of claim 5, wherein the mirror electrode structures are shaped in the form of cups, open toward the central lens electrode structure, with centrally located bottom apertures and the central lens electrode structure is in the form of an open cylinder.

12. The ion trap of claim 5, wherein the mirror electrode structures are each formed of a plate with an axially located aperture and a cup, open toward the central lens electrode structure, with an axially located aperture and the central lens electrode structure is in the form of a plate and with an axially located aperture.

13. The ion trap of claim 5, wherein the mirror electrode structures are each formed of at least two plates, an outer plate with an axially located aperture and at least one inner plate with an axially located aperture and the central lens electrode structure is in the form of a plate with an axially located aperture.

14. The ion trap of claim 5, wherein the mirror electrode structures are each formed of three plates, an outer plate with an axially located aperture and a first inner compensating electrode plate with an axially located aperture and a second inner plate with central aperture and the central lens electrode structure is in the form of a plate with an axially located aperture.

15. The ion trap of claim 5, wherein the first opposed mirror electrode structure is shaped in the form of a cup with a minimum of one off axis bottom aperture and the second opposed mirror electrode structure is shaped in the form of a cup with an axially located aperture and the central lens electrode structure is in the form of a plate with an axially located aperture.

16. The ion trap of claim 5, wherein the first opposed mirror electrode structure is shaped in the form of a cup with at least two diametrically opposed off axis bottom apertures and the second opposed mirror electrode structure is shaped in the form of a cup with an axially located aperture and the central lens electrode structure is in the form of a plate with an axially located aperture.

17. The ion trap of claim 1, configured as a plasma ion mass spectrometer, further including an ion detector.

18. The ion trap of claim 1, configured as an ion beam source, further including an ion source.

19. The ion trap of claim 1, configured as a mass spectrometer, further including an ion source and an ion detector.

20. The ion trap of claim 1, wherein the trajectories run in close proximity to and along an ion confinement axis.

21. The ion trap of claim 20, wherein the trap is cylindrically symmetric about a trap axis and the ion confinement axis is substantially coincident and parallel with the trap axis.

22. An ion trap mass spectrometer comprising:

a first mirror electrode structure and a second mirror electrode structure, and a central lens electrode plate having an applied bias voltage and having an axially located aperture, the electrodes adapted and arranged to produce electrostatic potentials that confine ions electrostatically both axially and radially to trajectories that run along an ion confinement axis, the ions having natural oscillation frequencies, the confining axial potential being anharmonic along the axis;

an AC excitation source having an excitation frequency and connected to at least one electrode and having an amplitude that is at least three orders of magnitude smaller than the absolute magnitude of the bias voltage applied to the central lens electrode;

a scan control system that reduces a frequency difference between the excitation frequency and the natural oscillation frequencies of the ions to achieve autoresonance;

an ion source; and at least one ion detector.

23. The mass spectrometer of claim 22, wherein the ion source is an electron impact ionization ion source.

24. The mass spectrometer of claim 23, wherein the electron impact ionization ion source is positioned along the linear axis of the ion trap.

25. The mass spectrometer of claim 22, wherein the ion detector contains an electron multiplier device.

26. The mass spectrometer of claim 25, wherein the ion detector is positioned off axis with respect to the linear axis of the ion trap.

27. The mass spectrometer of claim 22, wherein the ion source is an electron impact ionization ion source, and the ion detector contains an electron multiplier device ion detector positioned off axis with respect to the linear axis of the ion trap.

28. The mass spectrometer of claim 27, wherein the scan control system is configured to sweep the AC excitation frequency.

29. The mass spectrometer of claim 28, wherein the scan control system is configured to sweep the AC excitation frequency from a frequency higher than initial natural oscillation frequencies of the ions to a frequency lower than the initial natural oscillation frequencies of the ions.

30. An ion trap comprising:

means for electrostatically trapping the ions both axially and radially within an anharmonic potential created by an electrode structure;

means for applying an AC drive at a frequency other than the natural oscillation frequencies of the ions and with an amplitude larger than a threshold amplitude;

means for changing the conditions of the trap to reduce the frequency difference between the drive frequency and the natural oscillation frequencies of the ions to mass selectively achieve autoresonance; and means for continuing to change the conditions of the trap while maintaining autoresonance, with energy being pumped from the AC drive to the ions.

31. The ion trap of claim 1, wherein the electrode structure includes at least one mirror electrode structure.

32. The ion trap of claim 1, wherein the electrode structure includes at least one compensating electrode.

33. The ion trap of claim 19, wherein the ions are generated continuously while the excitation frequency is scanned.

34. The ion trap of claim 19, wherein the ions are generated in a time period immediately preceding the start of the excitation frequency scan.

35. The mass spectrometer of claim 22, wherein the first mirror electrode structure and the second mirror electrode structure are each formed of at least two plates, an outer plate with an axially located aperture and at least one inner plate with an axially located aperture.

36. The mass spectrometer of claim 22, wherein the autoresonance ejects ions into another ion manipulation system.

37. An ion trap comprising:

an electrode structure that produces electrostatic potentials that confine ions both axially and radially to trajectories at natural oscillation frequencies, the confining axial potential being anharmonic, and the electrode structure including a first opposed mirror electrode structure and a second opposed mirror electrode structure and a central lens electrode structure, each mirror electrode structure including at least one compensating electrode; and an AC excitation source having an excitation frequency and connected to at least one electrode of the electrode structure.

38. An ion trap comprising:

an electrode structure, including first and second opposed mirror electrodes and a central lens therebetween, that produces electrostatic potentials that confine ions both axially and radially to trajectories at natural oscillation frequencies, the confining axial potential being anharmonic; and an AC excitation source connected to at least one electrode having an excitation frequency f that excites confined ions at a frequency of about at least one integral multiple of the natural oscillation frequencies of the ions.

39. A mass spectrometer comprising:

an ion source;

an ion trapping electrode structure, including first and second opposed mirror electrode structures and a central lens structure therebetween having an applied bias voltage and having an axially located aperture, said ion trapping electrode structure producing an electrostatic potential distribution that confines ions both axially and radially to trajectories about a confinement axis, said confined ions oscillating along said confinement axis with natural oscillation frequencies, the confining electrostatic potential distribution being anharmonic along said confinement axis;

an AC source connected to at least one electrode, said AC source operating at a driving frequency f, and operating at an AC source amplitude, and driving confined autoresonant ions, thereby increasing the energies of said confined autoresonant ions;

a scan controller that controls said applied bias voltage and said driving frequency f and said AC source amplitude; and an ion detector.

40. The mass spectrometer of claim 39, wherein the scan controller increases the magnitude of the applied bias voltage with time, the electrostatic potential distribution scales uniformly, said confined autoresonant ions are mass-selectively ejected from the ion trapping electrode structure and thereafter are detected at the ion detector.

41. The mass spectrometer of claim 39, wherein the scan controller decreases the driving frequencyfwith time, said confined autoresonant ions are mass-selectively ejected from the ion trapping electrode structure and thereafter are detected at the ion detector.

42. The mass spectrometer of claim 39, wherein the AC source drives said confined autoresonant ions at integer multiples of the natural oscillation frequency of said confined autoresonant ions.

43. The mass spectrometer of claim 39, wherein the ion trapping electrode structure includes a minimum of one additional compensating electrode, said minimum of one additional compensating electrode having an axially located aperture and having a minimum of one applied bias voltage.

* * * * *